US011545074B2

(12) United States Patent
Yamashita et al.

(10) Patent No.: US 11,545,074 B2
(45) Date of Patent: Jan. 3, 2023

(54) DISPLAY DEVICE HAVING CONFIGURATION FOR CONSTANT CURRENT SETTING TO IMPROVE CONTRAST AND DRIVING METHOD THEREFOR

(71) Applicant: SAMSUNG ELECTRONICS CO., LTD., Suwon-si (KR)

(72) Inventors: Junichi Yamashita, Yokohama (JP); Daisuke Kawae, Yokohama (JP); Shinji Yamashita, Yokohama (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/278,440

(22) PCT Filed: Oct. 2, 2019

(86) PCT No.: PCT/KR2019/012981
§ 371 (c)(1),
(2) Date: Mar. 22, 2021

(87) PCT Pub. No.: WO2020/071826
PCT Pub. Date: Apr. 9, 2020

(65) Prior Publication Data

US 2021/0358394 A1 Nov. 18, 2021

(30) Foreign Application Priority Data

Oct. 4, 2018 (JP) ..... JP2018-189108
Oct. 4, 2018 (JP) ..... JP2018-189109

(51) Int. Cl.
*G09G 3/32* (2016.01)
*G09G 3/3291* (2016.01)
(Continued)

(52) U.S. Cl.
CPC ..... *G09G 3/32* (2013.01); *G09G 3/2014* (2013.01); *G09G 3/3233* (2013.01);
(Continued)

(58) Field of Classification Search
None
See application file for complete search history.

(56) References Cited

U.S. PATENT DOCUMENTS 8,508,518 B2 8/2013 Uchino et al.
9,135,855 B2 9/2015 Kawae et al.
(Continued)

FOREIGN PATENT DOCUMENTS

JP 2007-333768 A 12/2007
JP 2008-304690 A 12/2008
(Continued)

OTHER PUBLICATIONS

Communication dated Jan. 28, 2020, issued by the International Searching Authority in counterpart International Application No. PCT/KR2019/012981 (PCT/ISA/220, 210, 237).
(Continued)

*Primary Examiner* — Chad M Dicke
(74) *Attorney, Agent, or Firm* — Sughrue Mion, PLLC

(57) ABSTRACT

A display device includes a plurality of pixel circuits each including: a light-emitting element; a pulse width modulation (PWM) controller configured to control whether to supply current to the light-emitting element; and a constant current controller configured to supply the current to the light-emitting element, wherein the constant current controller, the PWM controller, and the light-emitting element are connected in series between a first power line and a second power line to supply the current to the light-emitting element; and a transistor configured to turn off the light-emitting element during a constant current setting period is
(Continued)

provided between the first power line and the constant current controller.

16 Claims, 32 Drawing Sheets

(51) Int. Cl.
*G09G 3/20* (2006.01)
*G09G 3/3233* (2016.01)

(52) U.S. Cl.
CPC ... *G09G 3/3291* (2013.01); *G09G 2300/0819* (2013.01); *G09G 2300/0852* (2013.01); *G09G 2300/0861* (2013.01); *G09G 2300/0866* (2013.01); *G09G 2310/0262* (2013.01); *G09G 2320/02* (2013.01); *G09G 2320/029* (2013.01); *G09G 2320/066* (2013.01)

(56) References Cited

U.S. PATENT DOCUMENTS

| | | | | |
|---|---|---|---|---|
| 9,349,313 | B2 | 5/2016 | Kawae et al. | |
| 9,818,376 | B2 | 11/2017 | Chaji et al. | |
| 10,417,965 | B2 | 9/2019 | Nakamura | |
| 2004/0246202 | A1* | 12/2004 | Yamashita | H05B 45/60 345/30 |
| 2008/0218452 | A1* | 9/2008 | Kohno | G09G 3/3233 345/76 |
| 2013/0083000 | A1 | 4/2013 | Toyomura et al. | |
| 2014/0049182 | A1* | 2/2014 | Kawae | G09G 3/3233 315/227 R |
| 2014/0333680 | A1 | 11/2014 | Choi | |
| 2015/0279269 | A1 | 10/2015 | Ishii et al. | |
| 2018/0137818 | A1 | 5/2018 | Kim et al. | |
| 2018/0182279 | A1 | 6/2018 | Sakariya et al. | |
| 2021/0358414 | A1* | 11/2021 | Yang | G09G 3/3233 |

FOREIGN PATENT DOCUMENTS

| | | | |
|---|---|---|---|
| JP | 2013-76811 | A | 4/2013 |
| JP | 2013-104910 | A | 5/2013 |
| JP | 2014-38168 | A | 2/2014 |
| JP | 2014-109703 | A | 6/2014 |
| JP | 2015-187641 | A | 10/2015 |
| JP | 5927484 | B2 | 6/2016 |
| JP | 2018-63351 | A | 4/2018 |
| KR | 10-2009-0055473 | A | 6/2009 |
| KR | 10-2014-0071236 | A | 6/2014 |

OTHER PUBLICATIONS

Communication dated Oct. 25, 2021, from the European Patent Office in European Application No. 19869049.7.

Communication dated Jun. 21, 2022 issued by the Japanese Intellectual Property Office in counterpart English Japanese Application No. 2018-189109.

* cited by examiner

DISPLAY DEVICE HAVING CONFIGURATION FOR CONSTANT CURRENT SETTING TO IMPROVE CONTRAST AND DRIVING METHOD THEREFOR

TECHNICAL FIELD

Embodiments of the present disclosure relate to a display device, a driving circuit, a driving method of the display device, and an inspection method of the display device.

BACKGROUND ART

Display devices, such as an active matrix organic electro luminescence (EL) display or a light-emitting diode (LED) display, which are self-emitting devices, are known.

For example, Patent Document 1 (Japanese Patent Application Publication No. 2014-109703) discloses a display device that performs Pulse Width Modulation (PWM) emission control, constant current driving, i.e., constant current PWM driving, and performs panel gradation control through time division.

Micro LED displays capable of realizing a high dynamic range (HDR) and high color gamut are emerging as a form of next-generation TVs. In addition, there is a demand for a high-definition 8K-resolution TV that can realize realism and an immersion sensation.

DESCRIPTION OF EMBODIMENTS

Technical Problem

In the display device disclosed in Patent Document 1, in order to improve contrast, voltages of a first power line and a second power line should be controlled to cause a light-emitting device to be in a non-emission state during a constant current setting period and a signal component for constant current setting should be input from the first power line separated for each RGB pixel circuit, and a configuration for making the light-emitting device be in the non-emission state during the constant current setting period is complicated.

To address the above problems, embodiments of the present disclosure are directed to providing a display device having a simple circuit construction and capable of controlling a light emitting device to be in a non-emission state during a constant current setting period, a driving circuit, and a driving method of the display device.

Solution to Problem

According to an aspect of the present disclosure, a display device includes: a plurality of pixel circuits each including a light-emitting element, a pulse width modulation (PWM) controller configured to control whether to supply current to the light-emitting element, and a constant current controller configured to supply the current to the light-emitting element, wherein the constant current controller, the PWM controller, and the light-emitting element are connected in series between a first power line and a second power line to supply the current to the light-emitting element; and a transistor configured to turn off the light-emitting element during a constant current setting period and provided between the first power line and the constant current controller.

The display device may further include an emission controller including a fifth transistor having a gate terminal connected to a third gate line. The PWM controller may include: a first transistor, a first capacitor having one terminal connected to a gate terminal of the first transistor, and a second transistor having a source terminal connected to the gate terminal of the first transistor and the one terminal of the first capacitor, a gate terminal connected to a first gate line, and a drain terminal connected to a data line. The constant current controller may include: a third transistor of a source follower type, a second capacitor having one terminal connected to a gate terminal of the third transistor and another terminal connected to a source terminal of the third transistor, and a fourth transistor having a source terminal connected to the gate terminal of the third transistor and the one terminal of the second capacitor, a gate terminal connected to a second gate line, and a drain terminal connected to the gate line. The fifth transistor, the third transistor, the first transistor, and the light-emitting element may be sequentially connected in series between the first power line and the second power line to supply the current to the light-emitting element. The transistor configured to turn off the light-emitting element may be the fifth transistor.

In an embodiment, the emission controller may be commonly connected to a certain number of pixel circuits among the plurality of pixel circuits.

The display device may further include a timing controller including an inverter circuit or a switching element and connected to the first gate line.

In an embodiment, the first transistor, the second transistor, the third transistor, and the fourth transistor may have a different conductivity type from the fifth transistor.

In an embodiment, the constant current controller may include: a first transistor, a first capacitor having one terminal connected to a gate terminal of the first transistor and another terminal connected to a source terminal of the first transistor, and a second transistor having a source terminal connected to the gate terminal of the first transistor and the one terminal of the first capacitor, a gate terminal connected to a first gate line, and a drain terminal connected to a data line, the PWM controller may include: a third transistor, a second capacitor having one terminal connected to a gate terminal of the third transistor, and a fourth transistor having a source terminal connected to the gate terminal of the third transistor and the one terminal of the second capacitor, a gate terminal connected to a second gate line, and a drain terminal connected to the data line. The third transistor, the first transistor, and the light-emitting element may be sequentially connected in series between the first power line and the second power line to supply the current to the light-emitting element, and the transistor configured to turn off the light-emitting element is the third transistor.

In an embodiment, the display device may further include a timing controller including an inverter circuit or a switching element and connected to the second gate line.

In an embodiment, a digital signal to be supplied to the PWM controller and an analog signal to be supplied to the constant current controller may be supplied to the data line.

In an embodiment, constant current setting may be commonly performed by the constant current controller with respect to the plurality of pixel circuits, and PWM control may be individually performed by the PWM controller with respect to rows of the plurality of pixel circuits.

In an embodiment, the constant current controller may include: a first transistor, a first capacitor having one terminal connected to a gate terminal of the first transistor and another terminal connected to a source terminal of the first transistor and one terminal of the light-emitting element, a second terminal having a source terminal connected to the source terminal of the first transistor and another terminal of the first capacitor, a gate terminal connected to a first gate line, and a drain terminal connected to a data line, and a third transistor connected to the gate terminal of the first transistor and the one terminal of the first capacitor, a gate terminal of a second gate line, and a drain terminal connected to the data line, the PWM controller may include: a fourth transistor, a second capacitor having one terminal connected to a gate terminal of the fourth transistor and another terminal connected to a third gate line, and a fifth transistor having a source terminal connected to the gate terminal of the fourth transistor and the one terminal of the second capacitor, a gate terminal connected to a fourth gate line, and a drain terminal connected to the data line, and the fourth transistor, the first transistor, and the light-emitting element are sequentially connected in series between a first power line and the second power line to supply the current to the light-emitting element.

In an embodiment, the data line may include a first data line and a second data line, and the drain terminal of the second transistor may be connected to the first data line, the drain terminal of the third transistor may be connected to the first data line or the second data line, and the drain terminal of the fifth transistor may be connected to the second data line.

In an embodiment, the display device may further include a light-emitting element evaluator connected to the first data line.

In an embodiment, the first transistor may have a different conductivity type from the fourth transistor.

In an embodiment, the first power line and the second power line may be set to fixed potentials during one frame period.

According to another aspect of the present disclosure, there is provided a driving circuit for controlling a display device including a plurality of pixel circuits, wherein each of the plurality of pixel circuits include a constant current controller, a PWM controller configured to control whether to supply current to a light-emitting element, and the light-emitting element that are connected in series between a first power line and a second power line to supply the current to the light-emitting element, and a transistor configured to turn off the light-emitting element during a constant current setting period and provided between the first power line and the constant current controller, and the driving circuit is configured to: supply signals to the plurality of pixel circuits through at least one gate line and at least one data line; initialize a transistor of the PWM controller after start of a constant current setting period; and restore the transistor of the PWM controller to a state before the constant current setting period before start of a sub-frame period.

In an embodiment, the constant current setting period may include a PWM reset period for turning off the transistor configured to turn off the light-emitting element and initializing the transistor of the PWM controller, and a constant current initialization period for initializing a gate-source voltage of the transistor of the constant current controller to a threshold voltage after the PWM reset period.

In an embodiment, the driving circuit may cause the transistor of the PWM controller to be in a conducting state during the constant current initialization period.

According to another aspect of the present disclosure, there is provided a driving method of a display device including a plurality of pixel circuits, wherein each of the plurality of pixel circuits includes: a constant current controller, a PWM controller configured to control whether to supply current to a light-emitting element, and the light-emitting element that are connected in series between a first power line and a second power line to supply the current to the light-emitting element, and a transistor configured to turn off the light-emitting element in a constant current setting period and provided between the first power line and the constant current controller, and the driving method includes initializing a transistor of the PWM controller after start of the constant current setting period; and restoring the transistor of the PWM controller to a state before the constant current setting period before start of a sub-frame period.

In an embodiment, when a gate-source voltage of a transistor of the constant current controller is set, a transistor of the PWM controller may be in a conducting state.

According to another aspect of the present disclosure, there is provided an inspection method of a display device with a pixel circuit including: a light-emitting element; a constant current controller including a first transistor, a first capacitor having one terminal connected to a gate terminal of the first transistor and another terminal connected to a source terminal of the first transistor and a terminal of the light-emitting element, a second transistor having a source terminal connected to the source terminal of the first transistor and another terminal of the first capacitor, a gate terminal connected to a first gate line, and a drain terminal connected to a drain terminal connected to a first data line, and a third transistor having a source terminal connected to the gate terminal of the first transistor and a terminal of the first capacitor, a gate terminal connected to a second gate line, and a drain terminal connected to the first data line or a second data line, and configured to supply current to the light-emitting element; and a PWM controller including a fourth transistor, a second capacitor having one terminal connected to a gate terminal of the fourth transistor and another terminal connected to a third gate line, and a fifth transistor having a source terminal connected to the gate terminal of the fourth transistor and a terminal of the second capacitor, a gate terminal connected to a fourth gate line, and a drain terminal connected to the second data line, and configured to switch whether to supply current to the light-emitting element, wherein the fourth transistor, the first transistor, and the light-emitting element are sequentially connected in series between a first power line and a second power line to supply current to the light-emitting element. When the light-emitting element is emitting light, a potential of one terminal of the light-emitting element is detected through the first data line DL3201.

Advantageous Effects of Disclosure

Embodiments of the present disclosure provide a display device having a simple circuit configuration and controlling a light emitting device to be in a non-emission state during a constant current setting period, thus improving contrast of an image to be displayed, a driving circuit, and a driving method of the display device.

BEST MODE

Figure 1:
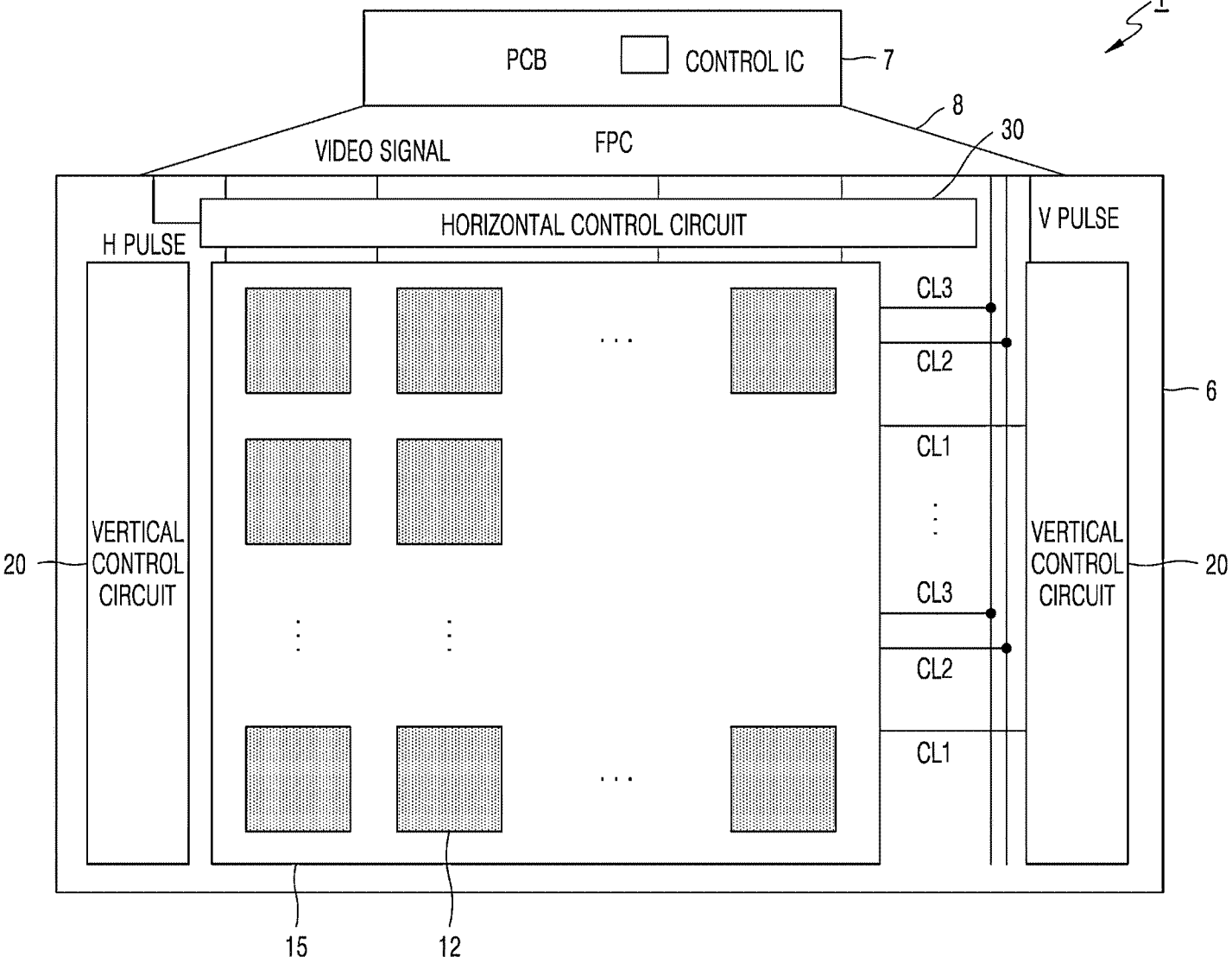
FIG. 1 is a diagram illustrating a schematic configuration of a display device (1) according to an embodiment of the present disclosure.

According to an aspect of the present disclosure, a display device includes: a plurality of pixel circuits each including a light-emitting element, a pulse width modulation (PWM) controller configured to control whether to supply current to the light-emitting element, and a constant current controller configured to supply the current to the light-emitting element, wherein the constant current controller, the PWM controller, and the light-emitting element are connected in series between a first power line and a second power line to supply the current to the light-emitting element; and a transistor configured to turn off the light-emitting element during a constant current setting period and provided between the first power line and the constant current controller.

MODE OF DISCLOSURE

In the present specification, the principles of embodiments will be described so that the scope of the claims may be clarified and those of ordinary skill in the art can implement embodiments described in the claims. The embodiments set forth herein may be implemented in many different forms.

The same reference numerals refer to the same elements throughout the specification. The present specification does not describe all elements of embodiments, and general matters in the technical field to which embodiments of the present disclosure pertain or the same matters in the embodiments will be omitted herein. The terms "module" or "unit" used herein may be embodied as one or a combination of two or more of software, hardware, or firmware, and a plurality of "modules" or "units" may be embodied as an element or one "module" or "unit" may include a plurality of elements. Hereinafter, a principle of operation of embodiments of the present disclosure and various embodiments will be described with reference to the accompanying drawings.

A display device according to an embodiment of the present disclosure is, for example, an active matrix self-emitting display, in which an emission controller, a constant current controller (constant current source), a PWM controller, and a light-emitting element are sequentially connected in series between power supplies to perform gradation representation by constant current driving of the light-emitting element and pulse width modulation.

Here, the light-emitting element, the PWM controller, and the constant current controller constitute one pixel circuit. Each of the PWM controller and the constant current controller includes two transistors and one capacitor. That is, according to an embodiment of the present disclosure, one pixel circuit includes a light-emitting element and a minimum number of four transistors and two capacitors (4Tr2C). The emission controller may include a (switching) transistor connected to a plurality of pixel circuits.

According to embodiments of the present disclosure, the constant current controller performs constant current setting, the PWM controller controls the light-emitting element to change between two states, e.g., an emission state and a non-emission state, and the emission controller controls the light-emitting element not to emit light during constant current setting. In embodiments of the present disclosure, constant current setting and PWM emission control may be performed by control pulses and power pulses input to the constant current controller, the PWM controller, and the emission controller of each pixel circuit. According to embodiments of the present disclosure, a current-voltage (I-V) characteristic difference of the light-emitting device, nonlinearity of current-light output (I_L) characteristics, and current dependent nonlinearity of color temperature may be corrected by constant current PWM driving to realize high emission uniformity, a panel emission time may be increased by controlling an emission period by inputting a digital signal, and high luminance may be realized.

Embodiments of the present disclosure may be used to implement a 75-inch 8K micro LED TV. A micro LED has a current dependence of luminance and chromaticity and thus needs to be controlled for high quality by constant current and time division driving.

In an 8K display, a pixel area is ¼ of an existing 4K display. Therefore, in order to realize a 75-inch 8K micro LED TV, it is necessary to perform constant current time division driving with a small number of elements. According to embodiments of the present disclosure, a constant current type digital PWM driving may be realized with a minimum number of pixels (4.3T2C) (i.e., 4.3 transistors and two capacitors), thereby achieving a high-definition panel. In addition, variations in characteristics of transistors of a constant current source may be compensated for, thereby realizing high uniformity display.

Hereinafter, a display device and a driving method thereof according to an embodiment of the present disclosure will be described with reference to the drawings.

First, a configuration of a display device according to an embodiment of the present disclosure will be described.

FIG. 1 is a diagram illustrating a schematic configuration of a display device 1 according to an embodiment of the present disclosure.

The display device 1 according to an embodiment of the present disclosure may correspond to various types of display devices including a self-emitting device. The display device 1 may correspond to, for example, a light-emitting diode (LED) display, an organic electroluminescence (EL) display, or the like. The display device 1 includes a panel 6, a controller 7, and a flexible printed circuit (FPC) 8 connecting the panel 6 to the PCB 7 corresponding to the controller.

The panel 6 includes a pixel array 15 including a plurality of pixel circuits 10 arranged in a matrix, and driving circuits such as a vertical control circuit 20 and a horizontal control circuit 30. The panel 6 may further include an emission controller included in each of the pixel circuits 10 or in a group of a certain number of pixel circuits 10. Each transistor of the driving circuit is, for example, a Thin-Film Transistor (TFT).

Each of the pixel circuits 10 of the panel 6 may correspond to sub-pixels constituting one pixel. One pixel is defined as a plurality of sub-pixels. Sub-pixels included in one pixel correspond to certain color components, and one pixel includes sub-pixels corresponding to certain color components. For example, one pixel may be defined as three pixel circuits 10 respectively corresponding to a sub-pixel R (red), a sub-pixel G (green), and a sub-pixel B (blue). As another example, one pixel may include one sub-pixel R, two sub-pixels G, and one sub-pixel B. A combination of color components of sub-pixels included in one pixel may be variously determined according to an embodiment. According to an embodiment, pixel circuits 10 corresponding to different colors may be arranged in each column. For example, columns of the pixel circuits 10 corresponding to different colors, e.g., a column of pixel circuits 10 corresponding to red (R), a column of pixel circuits 10 corresponding to green (G), and a column of pixel circuits 10 corresponding to blue (B), may be repeatedly arranged starting from a first column.

The vertical control circuit 20 outputs at least one type of control signal to each of the pixel circuits 10 through at least one gate line, e.g., gate lines CL1, CL2, and CL3. For example, the vertical control circuit 20 selects the first gate line CL1 and supplies a signal for PWM control to each row of the pixel circuit 10. The vertical control circuit 20 may include a plurality of stage circuits corresponding to rows, and the plurality of stage circuits may sequentially generate and output vertical control signals corresponding to the rows.

The horizontal control circuit 30 generates data signals corresponding to pixel values of image data and outputs the data signals to the pixel circuits 10 in columns through a data line DL1. The horizontal control circuit 30 selects a digital signal (image signal) or an analog signal output from the PCB 7 and transmitted through the FPC 8, and supplies the selected digital or analog signal to data lines DL1 corresponding to columns. The horizontal control circuit 30 sequentially receives the data signals corresponding to the columns from the PCB 7 and performs selector control, demultiplexer control, or the like to output data signals to the columns corresponding to the data signals.

The controller 7 generates a horizontal control pulse (H pulse) and a vertical control pulse (V pulse) and outputs the horizontal and vertical control pulses to the horizontal control circuit 30 and the vertical control circuit 20, respectively. The controller 7 may control a timing at which a data signal and a vertical control signal are output from the horizontal control circuit 30 and the vertical control circuit 20 to each of the pixel circuits 10 by using the horizontal control pulse and the vertical control pulse. In addition, the controller 7 may receive a data signal from another processor or an external device and output the data signal to the horizontal control circuit 30. The controller 7 may be embodied in the form of a printed circuit board (PCB) equipped with a control integrated circuit (IC).

Figure 2:
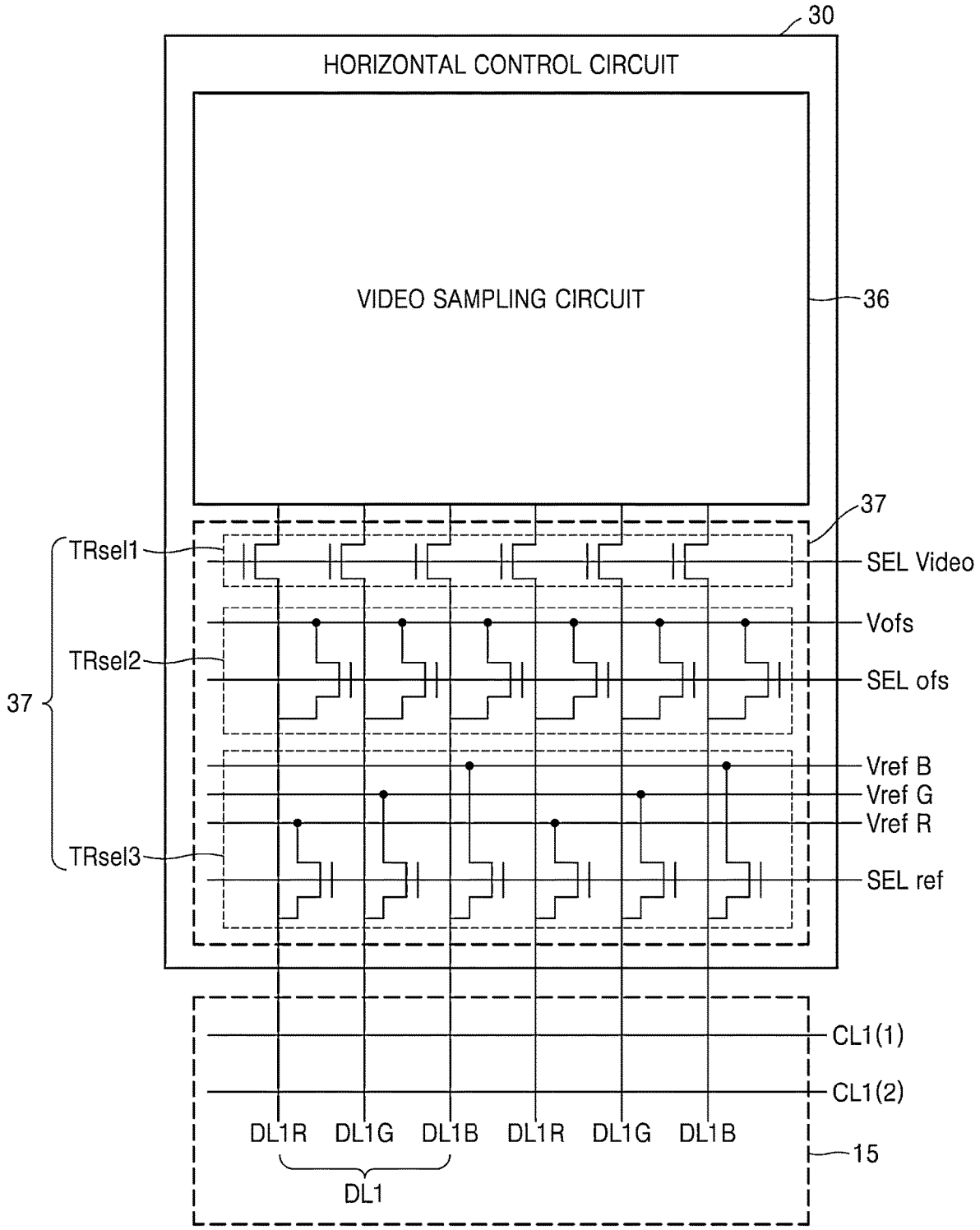
FIG. 2 is a diagram illustrating a schematic configuration of a horizontal control circuit (30) according to an embodiment of the present disclosure.

FIG. 2 is a diagram illustrating a schematic configuration of the horizontal control circuit 30 according to an embodiment of the present disclosure.

The horizontal control circuit 30 includes a video sampling circuit 36 and a constant current control signal switching circuit 37. The video sampling circuit 36 transmits a data signal corresponding to an input video signal to the constant current control signal switching circuit 37. The video sampling circuit 36 may sequentially output data signals corresponding to a plurality of columns of the pixel array 12. To this end, the video sampling circuit 36 may perform selector control or demultiplexer control to sequentially output the data signals to the plurality of columns of the pixel array 12. The video sampling circuit 36 may include a selector circuit or a demultiplexer circuit having any of various structures. According to an embodiment, the video sampling circuit 36 may separately include sampling circuits corresponding to color components of sub-pixels included in a pixel. For example, when the pixel includes three sub-pixels R, G, and B, the video sampling circuit 36 may include an R sampling circuit, a G sampling circuit, and a B sampling circuit.

The constant current control signal switching circuit 37 receives the data signals output from the video sampling circuit 36 and outputs the data signals to data lines DL1 corresponding to the columns of the pixel array 12. The constant current control signal switching circuit 37 selects a data line DL1 of a column corresponding to a data signal input from the video sampling circuit 36 and outputs the data signal to the selected data line DL1. Through switching control described above, the constant current control signal switching circuit 37 supplies a data signal to each of the pixel circuits 10 in a sub-frame period and supplies an analog signal with an offset voltage (reference voltage) Vofs to each of the pixel circuits 10 during a constant current setting period. The constant current control signal switching circuit 37 may include a first selection circuit TRsel1 for selecting the data lines DL1, a second selection circuit TRsel2 for applying the offset voltage Vofs, and a third selection circuit TRsel3 for applying a reference voltage Vref. The first selection circuit TRsel1 may include switching transistors corresponding to the data lines DL1, and select the data lines DL1 by turning the switching transistors on/off by a SEL video control signal. The second selection circuit TRsel2 may include a plurality of switching transistors having a first terminal connected to a voltage source of the offset voltage Vofs, a second terminal connected to the data lines DL1, and a gate terminal connected to a SEL ofs signal line. The constant current control signal switching circuit 37 may control application of the offset voltage Vofs to the data lines DL1 by a SEL ofs signal. The third selection circuit TRsel3 may include a plurality of switching transistors having a first terminal connected to a voltage source of the reference voltage Vref, a second terminal connected to the data lines DL1, and a gate terminal connected to a SEL ref signal line. The reference voltage Vref may include a plurality of reference voltages Vref R, Vref G, and Vref B corresponding to color components. The data lines DL1 may include an R data line DL1R corresponding to red (R), a G data line DL1G corresponding to green (G), and a B data line DL1B corresponding to blue (B). Each of the data lines DL1 may be connected to a voltage source of the reference voltage Vref R, Vref G, or Vref B corresponding to a color component of a corresponding data line DL1. The constant current control signal switching circuit 37 may control application of the reference voltage Vref R, Vref G, or Vref B to each of the data lines DL1 by the SEL ref signal. The sub-frame period, the constant current setting period, the offset voltage Vofs, and the reference voltage Vref will be described below.

Figure 3:
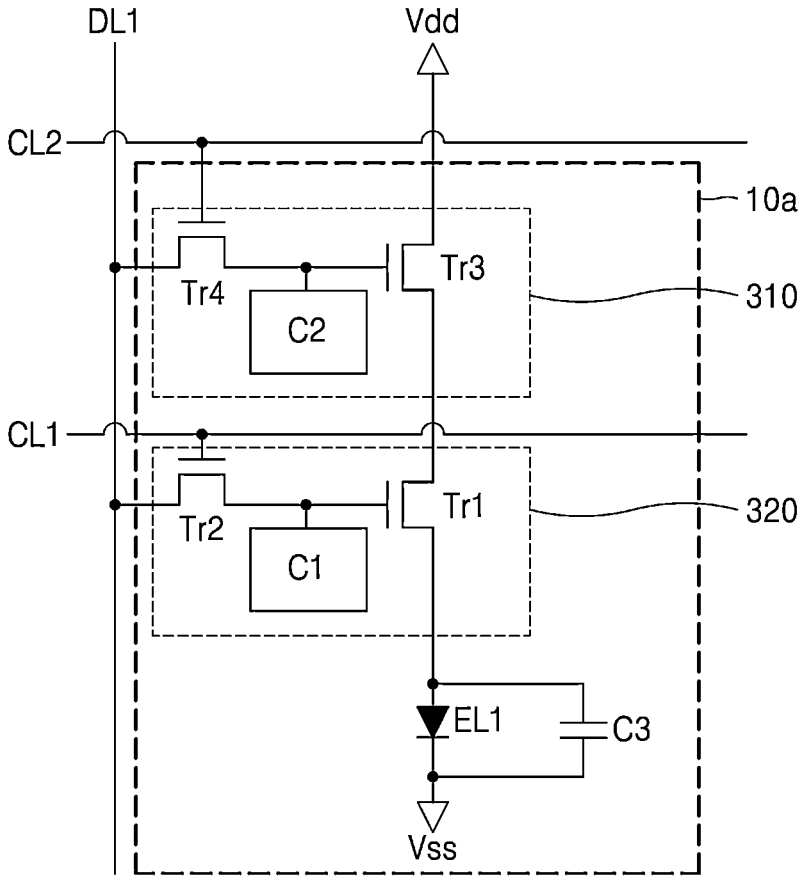
FIG. 3 is a diagram illustrating a configuration of a pixel circuit according to an embodiment of the present disclosure.

FIG. 3 is a diagram illustrating a configuration of a pixel circuit according to an embodiment of the present disclosure. A pixel circuit 10*a* of FIG. 3 corresponds to pixels in an $m^{th}$ row and an $n^{th}$ column of the pixel array 12 (m and n are natural numbers).

The pixel circuit 10*a* includes a light-emitting element EL1, a first current controller 310, and a second current controller 320. The first current controller 310 includes a third transistor Tr3, a fourth transistor Tr4, and a second capacitor C2. The second current controller 320 includes a first transistor Tr1, a second capacitor transistor Tr2, and a first capacitor C1. One of the first current controller 310 and the second current controller 320 corresponds to a PWM controller, and the other corresponds to a constant current controller. According to an embodiment of the present disclosure, a first power supply, the PWM controller, the constant current controller, the light-emitting element EU, and a second power supply may be sequentially connected in series or the first power supply, the constant current controller, the PWM controller, the light-emitting element EL1, and the second power supply may be sequentially connected in series. A control signal for PWM control may be supplied to the first current controller 310 or the second current controller 320 corresponding to the PWM controller, and a control signal for constant current control may be supplied to the first current controller 310 or the second current controller 320 corresponding to the constant current controller.

The light-emitting element EL1 is a light-emitting diode EL1, has general capacitive characteristics (capacitance component C3), and is also used as a capacitive device. The pixel circuit 10*a* may include a corresponding capacitor C3 of a TFT device, separately from the light-emitting diode EU, when the light-emitting diode EL1 does not include a capacitive component. A cathode of the light-emitting diode EL1 is electrically connected to a second power line Vss, and an anode thereof is electrically connected to a source terminal of the first transistor Tr1.

A gate terminal of the first transistor Tr1 is electrically connected to a source terminal of the second transistor Tr2 and a terminal of the first capacitor C1, a source terminal thereof is electrically connected to the anode of the light-emitting diode EL1 and another terminal of the first capacitor C1, and a drain terminal thereof is electrically connected to a source terminal of the third transistor Tr3 and another terminal of the second capacitor C2.

The second transistor Tr2 is a transistor that controls a timing of receiving a data signal from the data line DL1, a gate terminal thereof is electrically connected to the first gate line CL1, a drain terminal thereof is electrically connected to the data line DL1, and a source terminal thereof is electrically connected to the gate terminal of the first transistor Tr1 and a terminal of the first capacitor C1.

The first capacitor C1 is a device that holds a gate voltage Vg of the first transistor Tr1, and one terminal thereof is electrically connected to the gate terminal of the first transistor Tr1 and the source terminal of the second transistor Tr2. Another terminal of the first capacitor C1 may be electrically connected to the source terminal of the first transistor Tr1 and electrically connected to, for example, a fixed power supply such as 0 V (ground).

A gate terminal of the third transistor Tr3 is electrically connected to a source terminal of the fourth transistor Tr4 and one terminal of the second capacitor C2, a source terminal thereof is electrically connected to the drain terminal of the first transistor Tr1, and a drain terminal thereof is electrically connected to a first power line Vdd. The drain terminal of the third transistor Tr3 may be directly connected to the first power line Vdd or connected through at least one switching transistor.

The fourth transistor Tr4 is a transistor that controls a timing of transmitting a data signal from the data line DL1 to the third transistor Tr3, a gate terminal thereof is electrically connected to the second gate line CL2, a drain terminal thereof is electrically connected to the data line DL1, and a source terminal thereof is electrically connected to the gate terminal of the third transistor Tr3 and one terminal of the second capacitor C2.

The second capacitor C2 is a device that holds a gate voltage Vg of the third transistor Tr3, one terminal thereof is electrically connected to the gate terminal of the third transistor Tr3 and the source terminal of the fourth transistor Tr4, and another terminal is electrically connected to the source terminal of the third transistor Tr3 or electrically connected to a fixed power supply such as 0 V (ground).

The pixel circuit 10*a* includes a transistor provided between the first power line Vdd and the constant current controller to turn off the light-emitting element EL1 in a constant current setting period. In the display device 1 according to embodiments of the present disclosure, a source follower transistor is included in the constant current controller. The display device 1 may have a constant current setting period for initializing a voltage Vgs of the source follower transistor and setting the voltage Vgs to a threshold voltage Vgs of the source follower transistor of the constant current controller, thereby compensating for a threshold voltage Vth. The constant current setting period is performed before an emission period through PWM control. The pixel circuit 10*a* includes a transistor to turn off the light-emitting element EL1 during the constant current setting period. In an embodiment, the transistor for turning off the light-emitting element EL1 may be provided as a separate transistor other than the transistors Tr1 to Tr4 of FIG. 3 or a transistor of the transistor of the PWM controller may be used as a transistor for turning off the light-emitting element EL1.

Pixel circuits having various structures and driving methods thereof according to various embodiments of the present disclosure will be described below.

Figure 4:
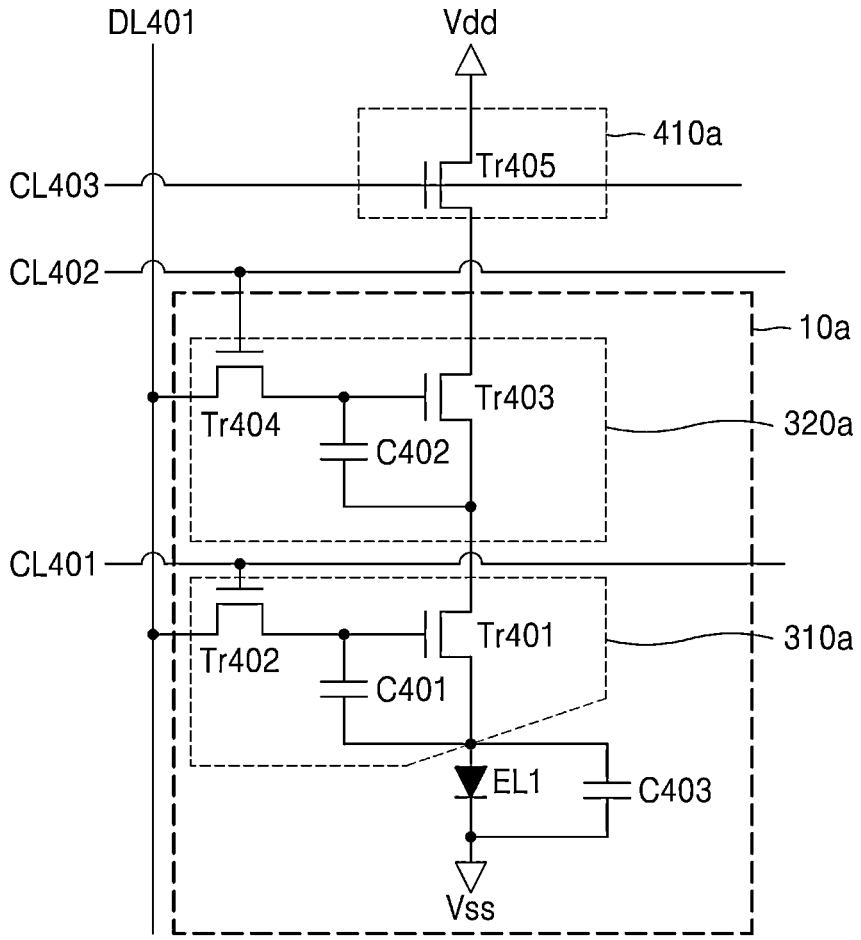
FIG. 4 is a circuit diagram illustrating configurations of a pixel circuit and an emission controller according to an embodiment of the present disclosure.

FIG. 4 is a circuit diagram illustrating configurations of a pixel circuit and an emission controller according to an embodiment of the present disclosure.

According to an embodiment of the present disclosure, the pixel circuit 10*a* includes a light-emitting element EL1, a PWM controller 310*a*, and a constant current controller 320*a*. The PWM controller 310*a* includes a fourth-first transistor Tr401, a fourth-second transistor Tr402, and a fourth-first capacitor C401. The constant current controller 320*a* includes a fourth-third transistor Tr403, a fourth-fourth transistor Tr404, and a fourth-second capacitor C402. The emission controller 410*a* includes a fourth-fifth transistor Tr405.

Here, the light-emitting element EL1 is a light-emitting diode EL1, has general capacitance characteristics (capacitance component C3), and is also used as a capacitor. When the light-emitting diode EL1 does not have a capacitance component, the pixel circuit 10*a* may include a third capacitor C3 separately from the light-emitting diode EL1. The capacitor C3 may be connected in parallel to both ends of the light-emitting diode EL1. A cathode of the light-emitting diode EL1 is electrically connected to a second power line Vss, and an anode thereof is electrically connected to a source terminal of the fourth-first transistor Tr401.

The fourth-first transistor Tr401 is a transistor for switching supplying of current to the light-emitting diode EL1, a gate terminal thereof is electrically connected to a source terminal of the fourth-second transistor Tr402 and a terminal of the fourth-first capacitor C401, a source terminal thereof is electrically connected to the anode of the light-emitting diode and a terminal of the fourth-first capacitor C401, and a drain terminal thereof is electrically connected to a source terminal of the fourth-third transistor Tr403 and a terminal of the fourth-second capacitor C402.

The fourth-second transistor Tr402 is a transistor that controls a timing of receiving a signal according to PWM control from the data line DL1. A gate terminal of the fourth-second transistor Tr402 is electrically connected to the fourth-first gate line CL401, a drain terminal thereof is electrically connected to the data line DL1, and a source terminal thereof is electrically connected to the gate terminal of the fourth-first transistor Tr401 and a terminal of the fourth-first capacitor C401.

The fourth-first capacitor C401 is a device that holds a gate voltage Vg of the fourth-first transistor Tr401, i.e., a device that holds data of the PWM controller 310*a*, and a terminal thereof is electrically connected to the gate terminal of the fourth-first transistor Tr401 and the source terminal of the fourth-second transistor Tr402. Another terminal of the fourth-first capacitor C401 may be electrically connected to the source terminal of the fourth-first transistor Tr401 or a fixed power supply such as the ground.

The fourth-third transistor Tr403 is a transistor that controls supply of current to the light-emitting diode EL1, a gate terminal thereof is electrically connected to the source terminal of the fourth-fourth transistor Tr404 and a terminal of the fourth-second capacitor C402, a source terminal thereof is electrically connected to the drain terminal of the fourth-first transistor Tr401 and a terminal of the fourth-second capacitor C402, and a drain terminal thereof is electrically connected to a source terminal of the fourth-fifth transistor Tr405.

The fourth-fourth transistor Tr404 is a transistor that controls a timing of receiving a signal from the data line DL1 according to constant current setting, a gate terminal thereof is electrically connected to the fourth-second gate line CL402, a drain terminal thereof is electrically connected to a data line DL401, and a source terminal thereof is electrically connected to the gate terminal of the fourth-third transistor Tr403 and a terminal of the fourth-second capacitor C402.

The fourth-second capacitor C402 is a device that holds a gate voltage Vg of the fourth-third transistor Tr403, and a terminal thereof is electrically connected to the gate terminal of the fourth-third transistor Tr403 and the source terminal of the fourth-fourth transistor Tr404, and a terminal thereof is electrically connected to the source terminal of the fourth-third transistor Tr403 and the drain terminal of the fourth-first transistor Tr401.

Here, because the constant current controller 320*a* is a gate-ground type source follower circuit and coupling of the fourth-third transistors Tr403 does not need to be controlled, the number of gate lines CL401, CL402, and CL403 that transmit a control signal to the pixel circuit 10*a* and the emission controller 410*a* may be reduced to three. Because constant current may be controlled at a gate of the fourth-third transistor Tr403, the second power line Vss may be set to a fixed potential. By performing constant current control at the gate of the fourth-third transistor Tr403, the second power line Vss may be shared by a plurality of sub-pixels, e.g., the pixel circuits 10*a* of R sub-pixels, G sub-pixels, and B sub-pixels. Alternatively, a pulse may be supplied to the second power line Vss instead of setting the second power line Vss to a fixed potential.

The fourth-fifth transistor Tr405 is a transistor for controlling power to stop emission of the light-emitting diode EL1 during the constant current setting period. A gate terminal of the fourth-fifth transistor Tr405 is electrically connected to the fourth-third gate line CL403, a drain terminal thereof is electrically connected to the first power line Vdd, and a source terminal thereof is electrically connected to the drain terminal of at least one fourth-third transistor Tr403. That is, the fourth-fifth transistor Tr405 may be connected in common to the plurality of pixel circuits 10*a*, and the plurality of pixel circuits 10*a* may be connected in parallel to the source terminal of the fourth-fifth transistor Tr405. One pixel circuit 10 may be connected to one fourth-fifth transistor Tr405, i.e., one fourth-fifth transistor Tr405 may be provided for each pixel circuit 10*a* corresponding to a sub-pixel.

Figure 5:
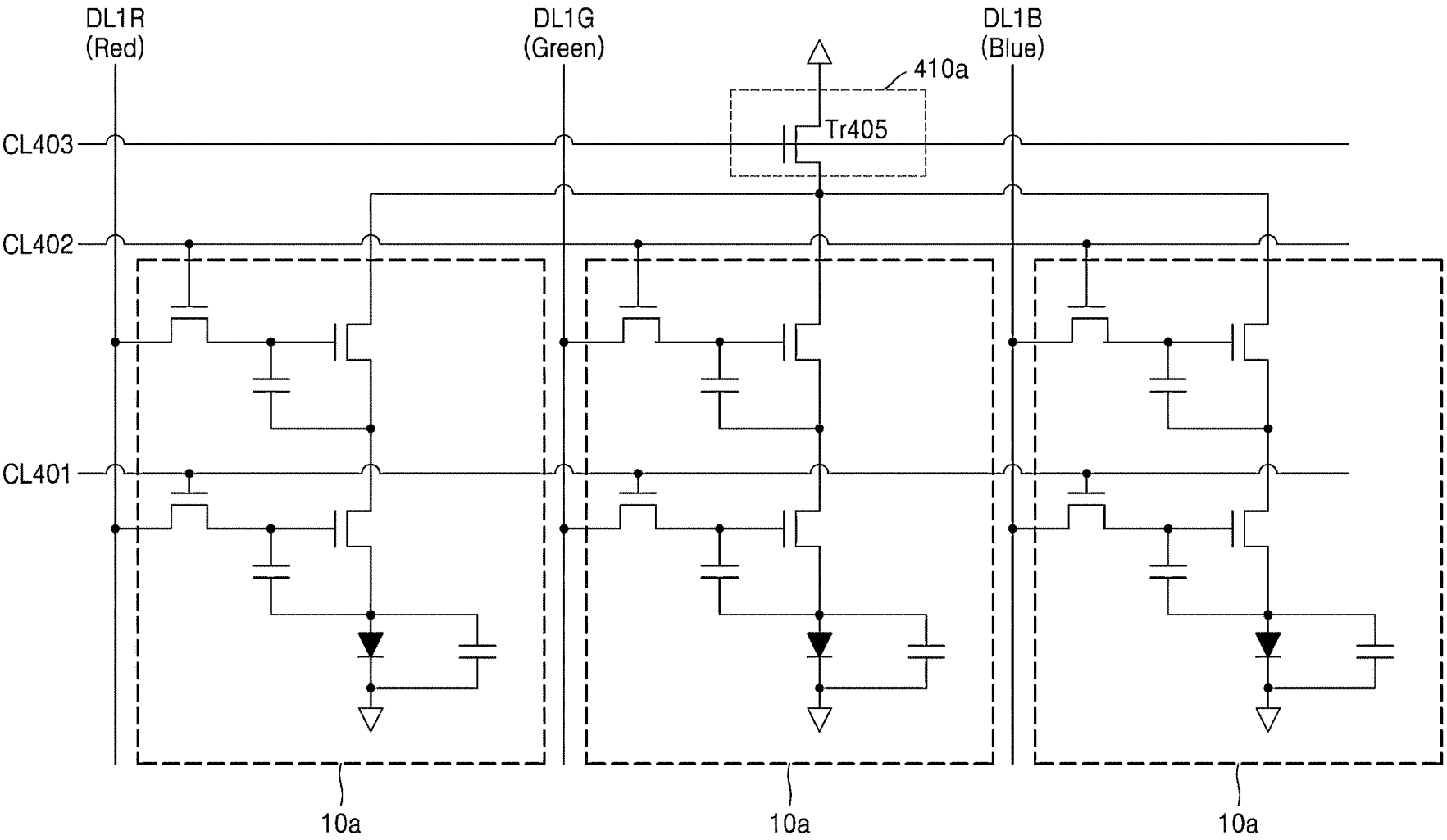
FIG. 5 is a circuit diagram illustrating a connection relationship between an emission controller and a plurality of pixel circuits according to an embodiment of the present disclosure.

FIG. 5 is a circuit diagram illustrating a connection relationship between an emission controller and a plurality of pixel circuits according to an embodiment of the present disclosure.

According to an embodiment, an emission controller 410*a* may be commonly connected to pixel circuits 10*a* of a plurality of sub-pixels. That is, the same fourth-fifth transistor Tr405 may be commonly connected to the plurality of pixel circuits 10*a* so that emission control may be performed in common with respect to the plurality of pixel circuits 10*a*. According to the present embodiment, the emission controller 410*a* may be commonly connected to a plurality of sub-pixels corresponding to one pixel. When one pixel includes k sub-pixels (k is a natural number), 1/k fourth-fifth transistors Tr405 correspond to the pixel circuit 10*a* and thus (4+1/k) transistors and two capacitors, i.e., a (4+1/k)Tr2C pixel circuit, may be configured. For example, the fourth-fifth transistors Tr405 may be shared by pixel circuits 10*a* corresponding to a plurality of sub-pixels R, G, and B. In this case, ⅓ of the fourth-fifth transistors Tr405 correspond to one pixel circuit 10*a*. That is, with respect to one pixel circuit 10*a*, the pixel circuit 10*a* and the emission controller 410*a* may be substantially configured as 4.3Tr2C.

The fourth-fifth transistors Tr405 may be shared by n pixel circuits 10*a*. In this case, 1/n fourth-fifth transistors Tr405 correspond to one pixel circuit 10*a*. By increasing n, for one pixel circuit 10*a*, the pixel circuit 10*a* and the emission controller 410*a* may be substantially configured as 4Tr2C. The number of pixel circuits 10*a* connected to one emission controller 410*a* may be variously determined according to embodiments.

The fourth-fifth transistor Tr405, the fourth-third transistor Tr403, the fourth-first transistor Tr401, and the light-emitting diode EL1 are sequentially and electrically connected in series between the first power line Vdd and the second power line Vss, and current is supplied to the light-emitting diode EL1. According to an embodiment, the display device 1 may supply a pulse to the first power line Vdd, thereby assisting constant current control performed by the constant current controller 320*a*.

The display device 1 includes three types of gate lines CL401, CL402, and CL403, and signals to be controlled differently for rows of the pixel array 15, i.e., to be sequential scanned, may be input via only the fourth-first gate line CL401 and signals may be input commonly to the entire panel via the fourth-second gate line CL402 and the fourth-third gate line CL403. In addition, signals may be input to the entire panel via the first power line Vdd. Accordingly, only one circuit is needed for sequential scanning and thus peripheral circuits such as the vertical control circuit 20 may be provided in a narrow frame in the panel 6.

According to embodiments of the present disclosure, as described below, constant current setting may be performed at the same timing with respect to all pixels, subsequent PWM control may be performed for each pixel row to temporally separate constant current control and PWM emission control, and data lines of analog signals for constant current setting and data lines of digital signals for PWM emission control may be shared in common and implemented as a single data line DL401, thereby greatly reducing the number of lines.

Next, an operation of the display device 1 according to an embodiment of the present disclosure, that is, a driving method of the display device 1, will be described focusing on a method of setting a constant current.

According to an embodiment of the present disclosure, one frame driving period of the display device 1 includes a constant current setting period and a sub-frame period, and the constant current setting of the display device 1 is performed in the constant current setting period. For example, four different sub-frame periods are provided and emission and non-emission of the light-emitting diode EL1 may be controlled in units of the sub-frame periods. This emission control will be referred to as PWM emission control. The number of sub-frame periods may be more or less than four and may be variously determined according to embodiments. The sub-frame periods may be set at a ratio weighted by binary code and determined in various ways. Generally, the constant current setting period is provided in a horizontal blanking period of each frame but may be provided only in one of horizontal blanking periods of a plurality of frames. A constant current setting cycle may be variously determined according to embodiments.

Figure 6:
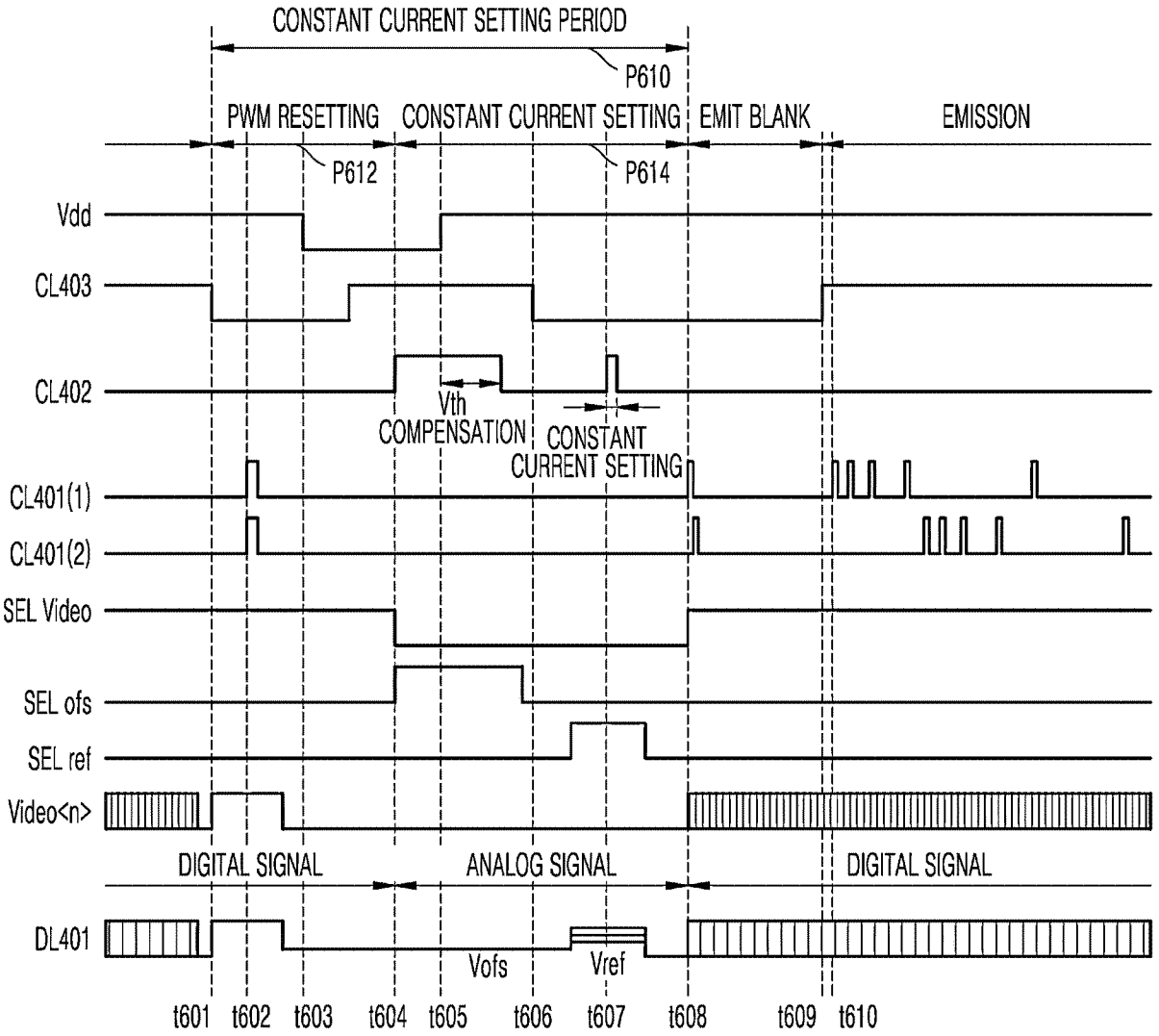
FIG. 6 is a timing chart for describing a driving method of the display device (1) according to an embodiment of the present disclosure.

FIG. 6 is a timing chart for describing a driving method of the display device 1 according to an embodiment of the present disclosure. A period (times t601 to t608) in which PWM resetting P612 and constant current setting P614 shown in the upper part of FIG. 6 are performed corresponds to a constant current setting period P610 as described above. In the display device 1, constant current controllers 320*a* are set within the constant current setting period P610 so that the constant current controllers 320*a* may supply constant current.

In the driving method of the display device 1 according to an embodiment of the present disclosure, the emission controller 410*a* and the constant current controller 320*a* are directly connected to significantly reduce an amplitude of a digital signal, which is supplied through the data line DL401, to the threshold voltage Vth of the light-emitting diode EL1 or a level around the threshold voltage Vth.

When the constant current setting period P610 starts, the display device 1 sets a potential of the fourth-third gate line CL403 to a low level (hereinafter, referred to as "L") to cause the fourth-fifth transistors Tr405 to be in a non-conducting state ("off" state) and to stop the supply of power to the light-emitting diodes EL1, thereby causing the light-emitting diodes EL1 to be simultaneously in the non-emission state (time t601).

Furthermore, the display device 1 sets a potential of the data line DL401 to a high level (hereinafter, referred to as "H") and a potential of the fourth-first gate line CL401 to H so that the fourth-second transistor Tr402 may be in a conducting state (on state) and the fourth-first transistor Tr401 for PWM control may be in the conducting state, and resets (initializes) the fourth-first transistor Tr401 to be used as a switching element in the constant current setting period P610 (time t602).

When the constant current setting period P610 starts (when non-emission starts) (time t1), a PWM signal is written to the gate of the fourth-first transistor Tr401, and whether the fourth-first transistor Tr401 is in the conducting state or the non-conducting state is different for each pixel circuit 10*a*. In this state, when constant current setting P614 is performed, a difference occurs in a constant current setting operation for each pixel circuit 10*a*. Accordingly, the display device 1 may perform PWM resetting P612 on the fourth-first transistor Tr401 and thus the fourth-first transistor Tr401 may be used as a switching element in the constant current setting period P610 and higher luminous uniformity of the display device 1 may be realized in a sub-frame period.

Subsequently, the display device 1 performs constant current setting (times t603 to t608) of the constant current controller 320*a*. Because the transistors Tr401 to Tr405 of the pixel circuit 10*a* are n type TFTs and have gaps in a threshold voltage Vth from each other, constant current setting P614 is performed by correcting voltage differences.

First, a potential of the first power line Vdd is changed to L that is equal to or less than a potential of the second power line Vss, and the fourth-fifth transistor Tr405 connected to the fourth-third gate line CL403 is caused to be in the conducting state (time t603). In this case, the fourth-first transistor Tr401 and the fourth-third transistor Tr403 are also in the conducting state, and the potential L of the first power line Vdd is written as an anode potential of the light-emitting diode EL1 and thus the potential of the light-emitting diode EL1 is also reset.

In addition, because the L potential of the first power line Vdd is less than or equal to the potential of the second power line Vss, the light-emitting diode EL1 may be in the non-emission state even when the fourth-fifth transistors Tr405 is in the conducting state. The potential of the first power line Vdd may be changed to L that is less than or equal to the potential of the second power line Vss before the constant current setting period P610, i.e., before the time t601, and thus, light-emitting diodes EL1 may be caused in the non-emission state at the same time.

Next, the display device 1 initializes a gate-source voltage Vgs of the fourth-third transistor Tr403 for constant current control by supplying an analog signal having an offset voltage Vofs converted from a digital signal to the data line DL401 and setting the potential of the fourth-second gate line CL402 to H, so that the fourth-fourth transistor Tr404 connected to the fourth-second gate line CL402 may be in the conducting state (time t604). In this case, the difference between the offset voltage Vofs and the potential L of the first power line Vdd is set to be higher than or equal to the threshold voltage Vth of the fourth-third transistor Tr403.

Thereafter, the potential of the first power line Vdd is changed to H (time t5). Accordingly, a current flows through the fourth-third transistor Tr403 and a source voltage Vs of the fourth-third transistor Tr403 increases. In this case, a gate of the fourth-third transistor Tr403 is fixed to the offset voltage Vofs, and an increase of the source voltage Vs of the fourth-third transistor Tr403 is stopped by cutting off the fourth-third transistor Tr403. The gate-source voltage Vgs of the fourth-third transistor Tr403 becomes equal to the threshold voltage Vth of the fourth-third transistor Tr403, thereby completing correction of the threshold voltage Vth of the fourth-third transistor Tr403 (Vth compensation). In this case, the source voltage Vs of the fourth-third transistor Tr403 is controlled not to be higher than an emission threshold voltage of the light-emitting diode EL1.

Next, a potential of the fourth-second gate line CL402 is set to L to cause the fourth-fourth transistor Tr404 connected to the fourth-second gate line CL402 to be in the non-conducting state, and then a potential of the fourth-third gate line CL403 is set to L to cause the fourth-fifth transistor Tr405 connected to the fourth-third gate line CL403 to be in the non-conducting state (time t606).

Next, the potential of the data line DL401 is rewritten from the offset voltage Vofs to a reference voltage Vref, and thereafter, a potential of the fourth-second gate line CL402 is set to H, so that the fourth-fourth transistor Tr404 connected to the fourth-second gate line CL402 may be in the conducting state (time t607). Accordingly, the gate-source voltage Vgs corresponding to a constant current value of the fourth-third transistor Tr403 of each constant current controller 320*a* may be set using an analog signal having the reference voltage Vref. In this case, the reference voltage Vref is written by being capacitance-divided into a capacitance of the fourth-second capacitor C402 and a capacitance component C3 of the light-emitting diode EL1.

The reference voltage Vref may have different values for the RGB data lines DL1R, DL1G, and DL1B. The fourth-fifth transistor Tr405 connected to the fourth-third gate line CL403 is in the non-conducting state and current does not flow from the first power line Vdd to the second power line Vss. Therefore, the non-emission state of the light-emitting diode EL1 is maintained.

Next, potentials of the fourth-first gate lines CL401 in pixel rows are sequentially set to H so that the fourth-second transistors Tr402 connected to the fourth-first gate lines CL401 in the pixel rows may be in the conducting state, and a PWM digital signal is written to the fourth-first transistor Tr401 to restore the fourth-first transistor Tr401 to the state before the PWM resetting P612, i.e., the state before the constant current setting period P610, thereby preparing for emission of the light-emitting diode EL1 (time t608).

Next, a potential of the fourth-third gate line CL403 is set to H so that the fourth-fifth transistor Tr405 connected to the fourth-third gate line CL403 may be in the conducting state, and PWM emission is simultaneously started in the pixel circuits 10*a* (time t609).

Thereafter, for each sub-frame, a potential of the fourth-first gate line CL401 is set to H so that a PWM signal may be written to the gate of the fourth-first transistor Tr401, and a current value of the constant current controller 320*a* is controlled by time division to control emission gradation of the light-emitting diode EL1 (time t610).

As described above, in the display device 1 according to an embodiment of the present disclosure, the fourth-fifth transistor Tr405 of the emission controller 410*a* is provided between the first power line Vdd and the constant current controller 320*a*, so that a light-emitting device may be in the non-emission state in the constant current setting period P610, thereby improving contrast of an image to be displayed.

In addition, in the driving method of the display device 1 according to an embodiment of the present disclosure, non-uniform mobility (μ) of the fourth-third transistor Tr403 may be corrected, in addition to the correction of a threshold voltage difference (Vth compensation) (time t605) of the fourth-third transistor Tr403 for constant current control.

Figure 7:
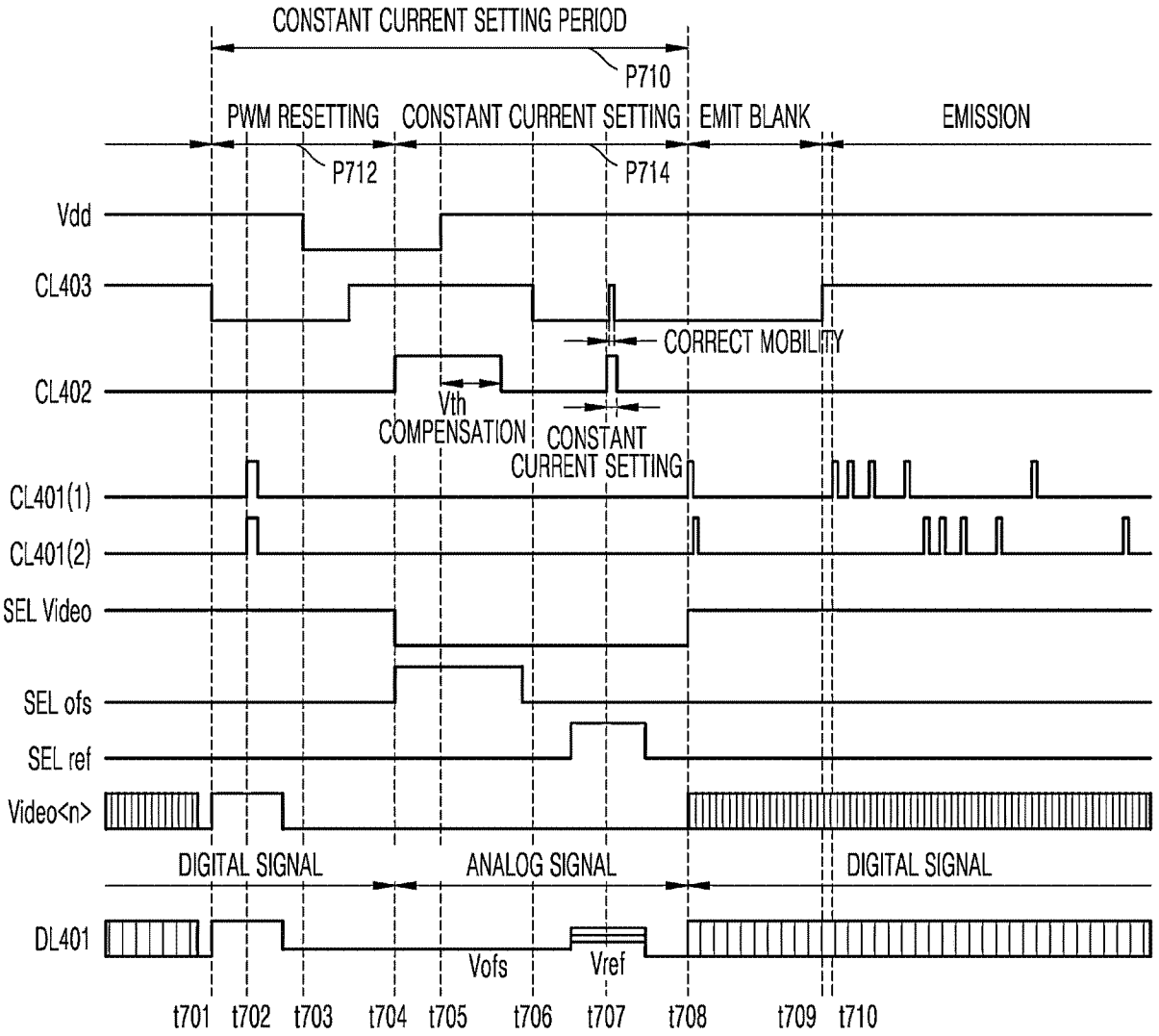
FIG. 7 is a timing chart for explaining a mobility (μ) correction method according to an embodiment of the present disclosure.

FIG. 7 is a timing chart for explaining a mobility μ correction method according to an embodiment of the present disclosure. The timing chart of FIG. 7 is different from the timing chart of FIG. 6, in that at time t707, after setting a potential of the fourth-second gate line CL402 to H, a potential of the fourth-third gate line CL403 is set to H.

That is, when constant current setting is performed by setting the gate-source voltage Vgs of the fourth-third transistor Tr403, the potential of the fourth-third gate line CL403 is set to H so that the fourth-fifth transistor Tr405 may be in the conducting state, thereby correcting non-uniform mobility μ of the fourth-third transistor Tr403.

A write time of a PWM signal by the fourth-first gate line CL401 after a time t710 is a time (e.g., a μs level) obtained by dividing a field period by the number of panel stages and the number of gradations, and is about 1/10 or 1/20 of a time obtained by dividing a field period of a general PWM signal write time by the number of panel stages. Therefore, in the panel 6, for example, a timing controller including a plurality of inverter circuits or switch elements may be connected to the fourth-first gate line CL401, so that the dullness of pulses supplied to the fourth-first gate line CL401 may be shaped to align timing of the pulses.

Figure 8:
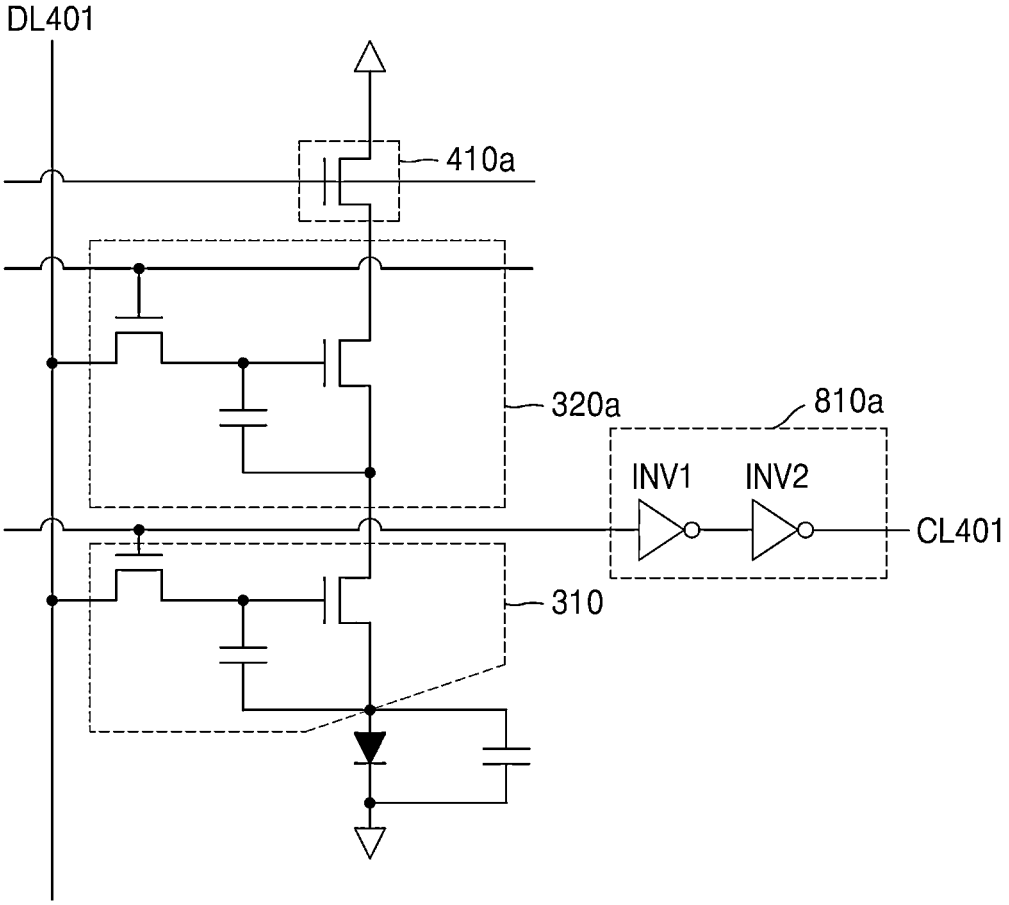
FIG. 8 is a diagram illustrating a configuration of a timing controller according to an embodiment of the present disclosure.
Figure 9:
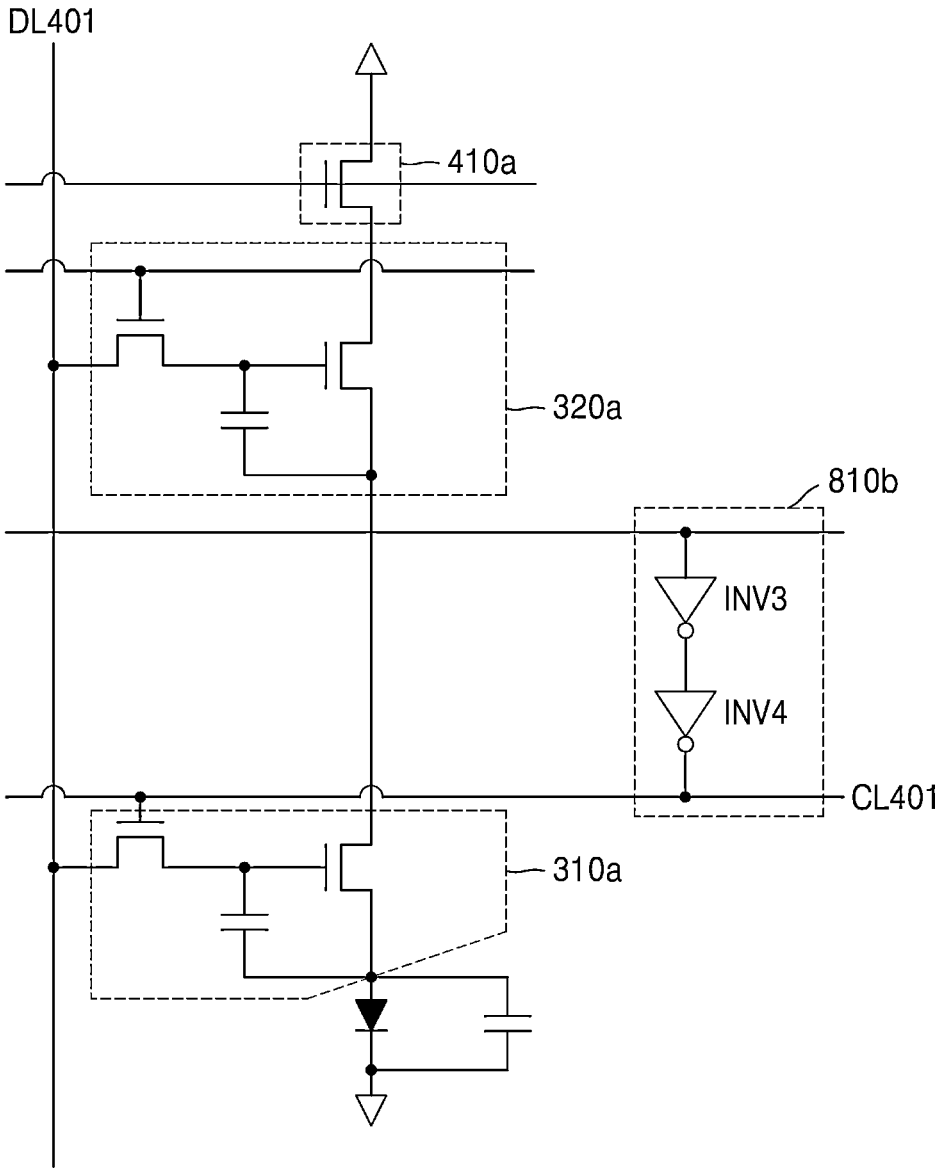
FIG. 9 is a diagram illustrating a configuration of a timing controller according to another embodiment of the present disclosure.

FIG. 8 is a diagram illustrating a configuration of a timing controller according to an embodiment of the present disclosure. FIG. 9 is a diagram illustrating a configuration of a timing controller according to another embodiment of the present disclosure.

Inverter circuits INV1, INV2, INV3, and INV4 of timing controllers 810*a* and 810*b* may be connected in series to a fourth-first gate line CL401 as illustrated in FIGS. 8 and 9 or may be connected in series between the fourth-first gate line CL401 and another control line or gate line. The timing controller 810*a* or 810*b* may be installed for each pixel circuit 10*a* or one timing controller 810*a* or 810*b* may be installed for a plurality of pixel circuits 10*a*.

In the display device 1 of an embodiment of the present disclosure, all transistors constituting a driving circuit are n type transistors but may be p type transistors or may be n type transistors and p type transistors. For example, only the fourth-fifth transistor Tr405 may be a p type (or n type) transistor and the other transistors may be n type (or p type) transistors. That is, the transistors other than the fourth-fifth transistor Tr405 may be reverse conduction type transistors, and thus, a gate potential of the fourth-fifth transistor Tr405 may be easily set.

As described above, the display device 1 according to an embodiment of the present disclosure includes: a light-emitting element EL1; a pixel circuit 10*a* including a PWM controller 310*a* for switching whether to supply current to the light-emitting element EL1, and a constant current controller 320*a* of a source follower type for supplying current to the light-emitting element EL1, wherein the PWM controller 310*a* and the light-emitting element EL1 are connected in series between a first power line Vdd and a second power line Vss to supply current to the light-emitting element EL1; and a transistor Tr5 provided between the first power line Vdd and the constant current controller 320*a* to turn off the light-emitting element EL1 in a constant current setting period.

Due to the above configuration, a light-emitting device may be in the non-emission state in the constant current setting period P610 through a simple circuit construction.

Alternatively, a display device 1 according to an embodiment of the present disclosure may include: a pixel circuit 10*a* including a light-emitting element EL1, a PWM controller 310*a* including a fourth-first transistor Tr401, a fourth-first capacitor C401 having a terminal connected to a gate terminal of the fourth-first transistor Tr401, and a fourth-second transistor Tr402 having a source terminal connected to a gate terminal of the fourth-first transistor Tr401 and a terminal of the fourth-first capacitor C401, a gate terminal connected to the fourth-first gate line CL401, and a drain terminal connected to a data line DL401, and configured to switch whether to supply current to the light-emitting element EL1, and a constant current controller 320*a* including a fourth-third transistor Tr403, a fourth-second capacitor C402 having a terminal connected to a gate terminal of the fourth-third transistor Tr403 and another terminal connected to a source terminal of the fourth-third transistor Tr403, and a fourth-fourth transistor Tr404 having a source terminal connected to the gate terminal of the fourth-third transistor Tr403 and a terminal of the fourth-second capacitor C402, a gate terminal connected to the fourth-second gate line CL402, and a drain terminal connected to the data line DL401, and configured to supply current to the light-emitting element EL1; and an emission controller 410*a* including a fourth-fifth transistor Tr405 having a gate terminal connected to the fourth-third gate line CL403 and configured to turn off a plurality of light-emitting elements EL1 in a constant current setting period (times t601 to t608). The fourth-fifth transistor Tr405, the fourth-third transistor Tr403, the fourth-first transistor Tr401, and the light-emitting element EL1 may be sequentially connected in series between a first power line Vdd and a second power line Vss to supply current to the light-emitting element EL1.

Due to the above configuration, each pixel circuit 10*a* may be configured with a minimum number of elements and a minimum number of gate lines, thereby further realizing high precision and a high degree of details of an image.

The display device 1 according to an embodiment of the present disclosure may further include a timing controller 810*a* including an inverter circuit INV or a switching element and connected to the fourth-first gate line CL401.

Due to the above configuration, the dullness of pulses supplied to the first gate line CL1 may be shaped in a sub-frame period to align timing of the pulses.

In the display device 1 according to an embodiment of the present disclosure, the fourth-first transistor Tr401, the fourth-second transistor Tr402, the fourth-third transistor Tr403, and the fourth-fourth transistor Tr404, and the fourth-fifth transistor Tr405 may be different conductivity-type transistors.

Due to the above configuration, a gate potential of the fourth-fifth transistor Tr405 may be more easily set.

In addition, in the display device 1 according to an embodiment of the present disclosure, a digital signal to be supplied to the PWM controller 310*a* and an analog signal to be supplied to the constant current controller 320*a* may be supplied to the data line DL401.

Due to above configuration, a data line for supplying a digital signal and a data line for supplying an analog signal may be integrated into one data line, thereby reducing the number of lines.

In the display device 1 according to an embodiment of the present disclosure, constant current setting may be simultaneously performed by the constant current controller 320*a* with respect to all pixel circuits 10*a*, and PWM control may be performed by the PWM controller 310*a* for every row of the pixel circuits 10*a*.

Due to the above configuration, the sizes of peripheral circuits, e.g., the vertical control circuit 20, the horizontal control circuit 30, etc. of the panel 6 and the widths thereof in a frame may be reduced, thereby reducing the size of the display device 1.

A driving circuit according to an embodiment of the present disclosure includes: a pixel circuit 10*a* including a light-emitting element EL1, a PWM controller 310*a* for switching whether to supply current to the light-emitting element EL1 and a constant current controller 320*a* of a source follower type for supplying current to the light-emitting element EL1, wherein the constant current controller 320*a*, the PWM controller 310*a*, and the light-emitting element EL1 are connected in series between a first power line Vdd and a second power line Vss to supply current to the light-emitting element EL1; and a transistor Tr5 provided between the first power line Vdd and the constant current controller 320*a* to turn off the light-emitting element EL1 in the constant current setting period.

Due to the above configuration, according to embodiments of the present disclosure, a light emitting device may be controlled to be in a non-emission state in the constant current setting period through a simple circuit configuration.

A driving circuit according to an embodiment of the present disclosure may include: a pixel circuit 10*a* including a light-emitting element EL1, a PWM controller 310*a* including a fourth-first transistor Tr401, a fourth-first capacitor C401 having a terminal connected to a gate terminal of the fourth-first transistor Tr401, and a fourth-second transistor Tr402 having a source terminal connected to a gate terminal of the fourth-first transistor Tr401 and a terminal of the fourth-first capacitor C401, a gate terminal connected to the fourth-first gate line CL401, and a drain terminal connected to a data line DL401, and configured to switch whether to supply current to the light-emitting element EL1, and a constant current controller 320*a* including a fourth-third transistor Tr403, a fourth-second capacitor C402 having a terminal connected to a gate terminal of the fourth-third transistor Tr403 and another terminal connected to a source terminal of the fourth-third transistor Tr403, and a fourth-fourth transistor Tr404 having a source terminal connected to the gate terminal of the fourth-third transistor Tr403 and a terminal of the fourth-second capacitor C402, a gate terminal connected to the fourth-second gate line CL402, and a drain terminal connected to the data line DL401, and configured to supply current to the light-emitting element EL1; and an emission controller 410*a* including a fourth-fifth transistor Tr405 having a gate terminal connected to the fourth-third gate line CL403 and configured to turn off a plurality of light-emitting elements EL1 in a constant current setting period (times t601 to t608). The fourth-fifth transistor Tr405, the fourth-third transistor Tr403, the fourth-first transistor Tr401, and the light-emitting element EL1 may be sequentially connected in series between a first power line Vdd and a second power line Vss to supply current to the light-emitting element EL1. Due to the above configuration, each pixel circuit 10*a* may be configured with a minimum number of elements and a minimum number of gate lines, and the precision and degree of details of an image may be increased.

In a driving method of a display device 1, which includes: a pixel circuit 10*a* including a light-emitting element EL1, a PWM controller 310*a* including a fourth-first transistor Tr401 and configured to switch whether to supply current to the light-emitting element EL1, and a constant current controller 320*a* of a source follower type including a fourth-third transistor Tr403 and configured to supply current to the light-emitting element EL1, wherein the fourth-third transistor Tr403 of the constant current controller 320*a*, the fourth-first transistor Tr401 of the PWM controller 310*a*, and the light-emitting element EL1 are connected in series between a first power line Vdd and a second power line Vss to supply current to the light-emitting element EL1; and a fourth-fifth transistor Tr405 provided between the first power line Vdd and the constant current controller 320*a* to turn off the light-emitting element EL1 in a constant current setting period, according to an embodiment of the present disclosure, the fourth-first transistor Tr401 of the PWM controller 310*a* is initialized after the start of the constant current setting period (time t602) and returned to a state before the constant current setting period before the start of a sub-frame period (time t408).

Due to the above configuration, the pixel circuit 10*a* may have a simple circuit configuration to allow a light emitting device to be in the non-emission state in the constant current setting period, and the fourth-first transistor Tr401 may be used as a switching element, thereby achieving higher luminous uniformity in the display device 1.

Alternatively, in a driving method of a display device 1 according to an embodiment of the present disclosure, which includes: a pixel circuit 10*a* including a light-emitting element EL1, a PWM controller 310*a* including a fourth-first transistor Tr401, a fourth-first capacitor C401 having a terminal connected to a gate terminal of the fourth-first transistor Tr401, and a fourth-second transistor Tr402 having a source terminal connected to a gate terminal of the fourth-first transistor Tr401 and a terminal of the fourth-first capacitor C401, a gate terminal connected to the fourth-first gate line CL401, and a drain terminal connected to a data line DL401, and configured to switch whether to supply current to the light-emitting element EL1, and a constant current controller 320*a* including a fourth-third transistor Tr403, a fourth-second capacitor C402 having a terminal connected to a gate terminal of the fourth-third transistor Tr403 and another terminal connected to a source terminal of the fourth-third transistor Tr403, and a fourth-fourth transistor Tr404 having a source terminal connected to the gate terminal of the fourth-third transistor Tr403 and a terminal of the fourth-second capacitor C402, a gate terminal connected to the fourth-second gate line CL402, and a drain terminal connected to the data line DL401, and configured to supply current to the light-emitting element EL1; and an emission controller 410*a* including a fourth-fifth transistor Tr405 having a gate terminal connected to the fourth-third gate line CL403 and configured to turn off a plurality of light-emitting elements EL1 in a constant current setting period (times t601 to t608), wherein the fourth-fifth transistor Tr405, the fourth-third transistor Tr403, the fourth-first transistor Tr401, and the light-emitting element EL1 are sequentially connected in series between a first power line Vdd and a second power line Vss to supply current to the light-emitting element EL1, the fourth-first transistor Tr401 may be initialized after the start of the constant current setting period (time t602) and returned to a state before the constant current setting period before the start of a sub-frame period (time 6608).

Due to the above configuration, each pixel circuit 10*a* may be configured with a minimum number of elements and a minimum number of gate lines, and the precision and degree of details of an image may be increased. In the driving method of the display device 1 according to an embodiment of the present disclosure, the fourth-fifth transistor Tr405 may be set to the conducting state when a gate-source voltage of the fourth-third transistor Tr403 is set.

Due to the above configuration, luminous uniformity of the display device 1 may be greatly increased by compensating for a threshold voltage and correcting mobility with respect to the fourth-third transistor Tr403 for constant current driving.

Figure 10:
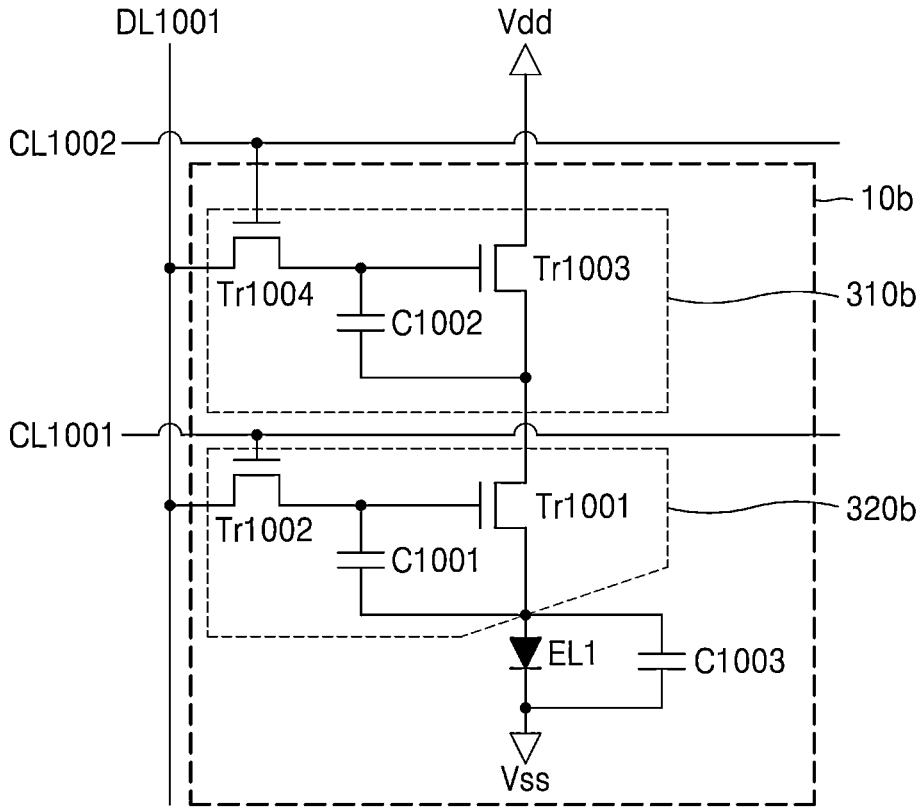
FIG. 10 is a circuit diagram illustrating a configuration of a pixel circuit according to another embodiment of the present disclosure.

FIG. 10 is a diagram illustrating a configuration of a pixel circuit according to another embodiment of the present disclosure.

According to another embodiment of the present disclosure, a display device 1 is, for example, an active matrix self-emitting display, in which a PWM controller 310*b*, a constant current controller 320*b*, and a light-emitting element EL1 are sequentially connected in series between power supplies to perform gradation representation by constant current driving of the light-emitting element EL1 and pulse width modulation.

In the present embodiment, the constant current controller 320*b*, the PWM controller 310*b*, and the light-emitting element EL1 constitute one pixel circuit 10*b*. Each of the constant current controller 320*b* and the PWM controller 310*b* includes two transistors and one capacitor, and one pixel circuit 10*b* includes a minimum number of elements, i.e., four transistors and two capacitors (4Tr2C).

The constant current controller 320*b* performs constant current setting, and the PWM controller 310*b* controls switching between two states and controls non-emission of the light-emitting element EL1 during constant current setting. Constant current setting and PWM emission control are performed by a control pulse and a power pulse to be input to the constant current controller 320*b* and the PWM controller 310*b*.

In the display device 1 according to the present embodiment, the PWM controller 310*b* may perform the functions of both the PWM controller 310*a* and the emission controller 410*a* of the embodiment according to FIG. 4 described above and thus the emission controller 410*a* including the fourth-third gate line CL403 and the fourth-fifth transistor Tr405 according to the embodiment of FIG. 4 may be omitted.

The display device 1 and a driving method thereof according to the present embodiment will be described with reference to FIGS. 10 to 12 below.

First, a configuration of the display device 1 according to the present embodiment will be described.

An illustration and description of the display device 1 and a horizontal control circuit 30 according to the present embodiment are omitted here, because schematic configurations thereof are similar to those of the display device 1 and the horizontal control circuit 30 of FIGS. 1 and 2, except that the third gate line CL3 is omitted.

Next, a configuration of the pixel circuit 10*b* will be described with reference to FIG. 10.

The pixel circuit 10*b* according to the present embodiment includes a light-emitting element EL1, the constant current controller 320*b*, and the PWM controller 310*b*. The constant current controller 320*b* includes a tenth-first transistor Tr1001, a tenth-second transistor Tr1002, and a tenth-first capacitor C1001, and the PWM controller 310*b* includes a tenth-third transistor Tr1003, a tenth-fourth transistor Tr1004, and a tenth-second capacitor C1002. One terminal of the tenth-first capacitor C1001 is electrically connected to a gate terminal of the tenth-first transistor Tr1001 and a source terminal of the tenth-second transistor Tr1002, and another terminal thereof is electrically connected to a source terminal of the tenth-first transistor Tr1001. One terminal of the tenth-second capacitor C1002 is electrically connected to a gate terminal of the tenth-third transistor Tr1003 and a source terminal of the tenth-fourth transistor Tr1004, and another terminal thereof is electrically connected to a source terminal of the tenth-third capacitor Tr1003 and a drain terminal of the tenth-first transistor Tr1001.

The configuration of the pixel circuit 10*b* is different from that of the pixel circuit 10*a* according to the embodiment of FIG. 4, in that the fourth-fifth transistor Tr405 and the fourth-third gate line CL403 of the embodiment of FIG. 4 are omitted and an arrangement of the constant current controller 320*b* and the PWM controller 310*b* is opposite to that of the PWM controller 410*a* and the constant current controller unit 420*a* according to the embodiment of FIG. 4. In addition, a description of elements of the pixel circuit 10*b* that are substantially the same as those of the pixel circuit 10*a* of FIG. 4 will be omitted here.

The other terminal of the tenth-second capacitor C1002 according to the present embodiment may be connected to a fixed power supply such as the ground or a source terminal of the tenth-third transistor Tr1003.

Next, an operation of the display device 1 according to the present embodiment, that is, a driving method of the display device 1 will be described.

Figure 11:
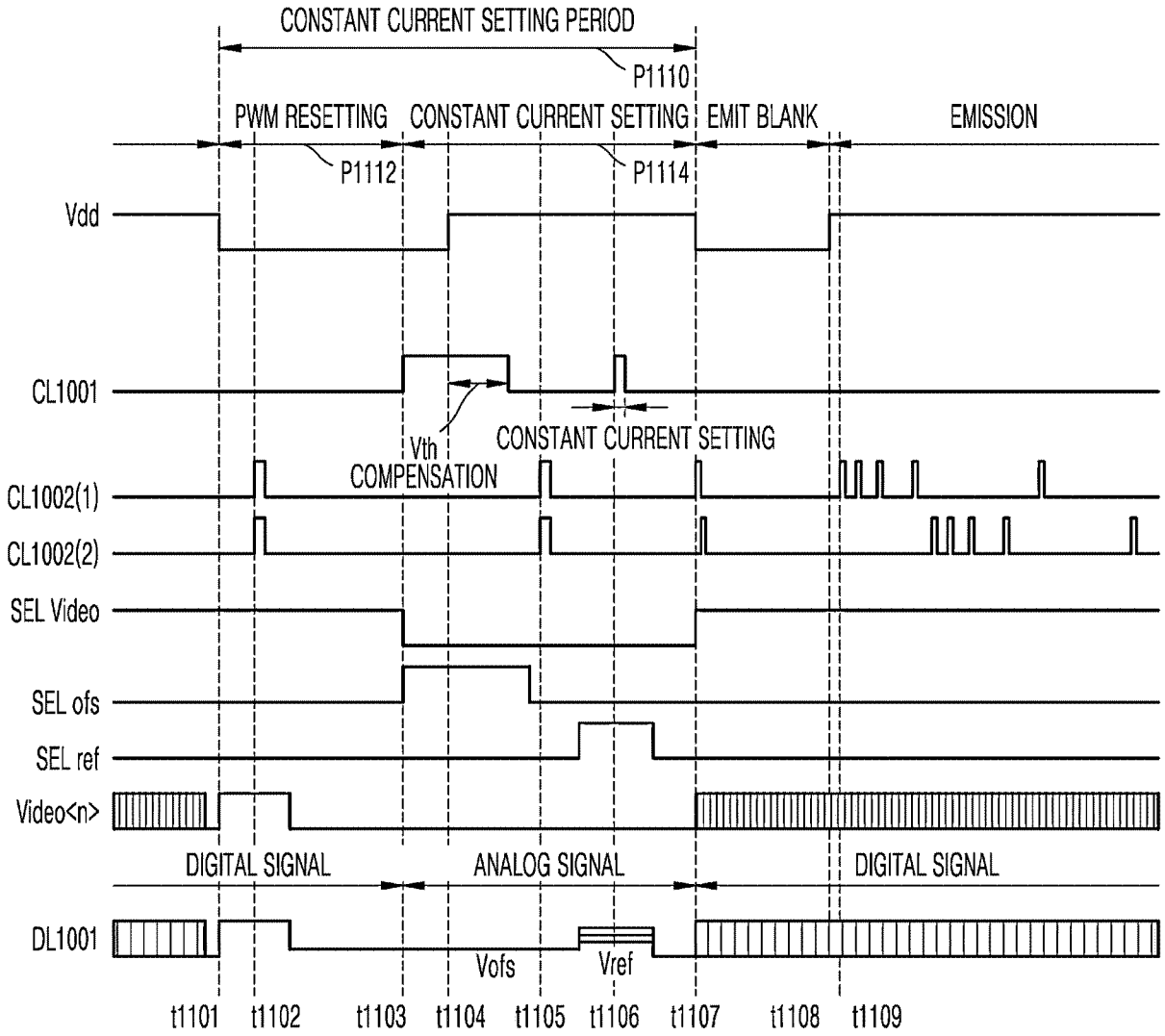
FIG. 11 is a timing chart for describing a driving method of a display device using the pixel circuit of FIG. 10.

FIG. 11 is a timing chart for describing a driving method of a display device using the pixel circuit of FIG. 10.

A period (times t1101 to t1107) in which PWM resetting P1112 and constant current setting P1114 shown in the upper part of FIG. 11 are performed corresponds to a constant current setting period P1110.

When the constant current setting period P1110 begins, first, a potential of a first power line Vdd is changed to L that is equal to or less than a potential of a second power line Vss, so that the light-emitting diode EL1 may be in the non-emission state (time t1101). Each constant current controller 320*b* is set in the constant current setting period P1110 so that each constant current controller 320*b* may supply constant current.

A potential of a data line DL1001 is set to H and a potential of the tenth-second gate line CL1002 is also set to H, so that the tenth-fourth transistor Tr1004 may be in the conducting state and the tenth-third transistor Tr1003 for PWM control may be in the conducting state, the tenth-third transistor Tr1003 is reset, and the tenth-third transistor Tr1003 is set to be available as a switching element in the constant current setting period P1110 (time t1102).

Next, an analog signal having an offset voltage Vofs converted from a digital signal is supplied to the data line DL1001 and a potential of the tenth-first gate line CL1001 is set to H to cause the tenth-second transistor Tr1002 connected to the tenth-first gate line CL1001 to be in the conducting state, thereby initializing a gate-source voltage Vgs of the tenth-first transistor Tr1001 for constant current control (time point t1103).

Thereafter, the potential of the first power line Vdd is changed to H (time t1104). Accordingly, current flows through the tenth-first transistor Tr1001 and a source voltage Vs of the tenth-first transistor Tr1101 increases. In this case, a gate of the tenth-first transistor Tr1001 is fixed to an offset voltage Vofs and an increase of the source voltage Vs of the tenth-first transistor Tr1001 is stopped by cutting off the tenth-first transistor Tr1001. The gate-source voltage Vgs of the tenth-first transistor Tr1001 becomes equal to a threshold voltage Vth thereof, thereby completing correction of the threshold voltage Vth of the tenth-first transistor Tr1001 (Vth compensation).

Next, a potential of the tenth-second gate line CL1002 is set to H to cause the tenth-fourth transistor Tr1004 connected to the tenth-second gate line CL1002 to be in the conducting state, and the tenth-third transistor Tr1003 for PWM control is controlled to be in the non-conducting state by an offset voltage Vofs of the data line DL1001 (time t1105). Thus, the first power line Vdd and the tenth-first transistor Tr1001 for constant current control are electrically disconnected from each other.

Thereafter, an analog signal having a reference voltage Vref is supplied to the data line DL1001 and a potential of the tenth-first gate line CL1001 is set to H so that the tenth-second transistor Tr1002 may be in the conducting state, and a gate-source voltage Vgs corresponding to a constant current value of the tenth-first transistor Tr1001 of each constant current controller 320*b* is set (time t1106). In this case, the tenth-third transistor Tr1003 is in the non-conducting state and no current flows from the first power line Vdd to the second power line Vss, and thus, a non-emission state of the light-emitting diode EL1 is maintained.

Subsequent operations, including preparing for emission of the light-emitting diode EL1 (time t1107) to controlling emission gradation of the light-emitting diode EL1 (time t1109), are the same as the operations (times t608 to t610) of the driving method of the pixel circuit 10*a* according to the embodiment of FIG. 4, and thus a description thereof is omitted here.

As described above, in the display device 1 according to the present embodiment, contrast of an image displayed may be improved by setting a light emitting device to be in the non-emission state in the constant current setting period by using the tenth-third transistor Tr1003 of the PWM controller 310*b* between the first power line Vdd and the constant current controller 320*b*.

Furthermore, in the driving method according to the present embodiment, non-uniform mobility μ of the tenth-first transistor Tr1001 may be corrected, as well as correcting a threshold voltage gap (Vth compensation) of the tenth-first transistor Tr1001 for constant current control.

Figure 12:
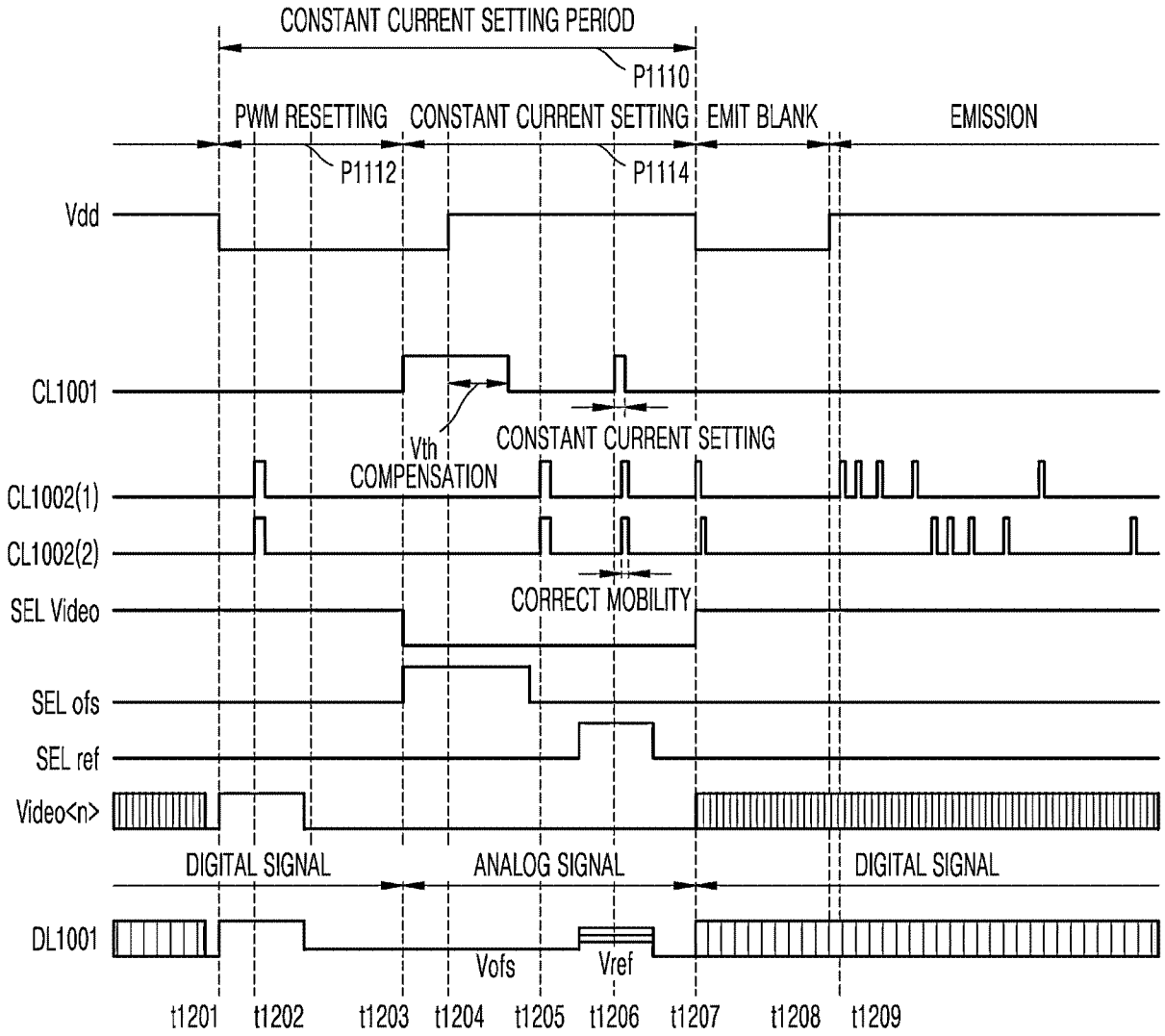
FIG. 12 is a timing chart for explaining a mobility (μ) correction method according to another embodiment of the present disclosure.

FIG. 12 is a timing chart for explaining a mobility (μ) correction method according to another embodiment of the present disclosure. The timing chart of FIG. 12 is different from the timing chart of FIG. 11, in that a potential of the tenth-second gate line CL1002 is set to H after a potential of the tenth-first gate line CL1001 is set to H at time point t1106.

That is, when constant current setting is performed by setting the gate-source voltage Vgs of the tenth-first transistor Tr1001, a potential of the tenth-second gate line CL1002 may be set to H so that the tenth-third transistor Tr1003 may be in the conducting state, thereby correcting non-uniform mobility μ of the tenth-first transistor Tr1001.

In addition, in the display device 1 according to the present embodiment, a timing controller may be provided inside a panel 6 and thus the dullness of pulses supplied to the tenth-second gate line CL1002 may be shaped in a sub-frame period to align timing of the pulses.

Figure 13:
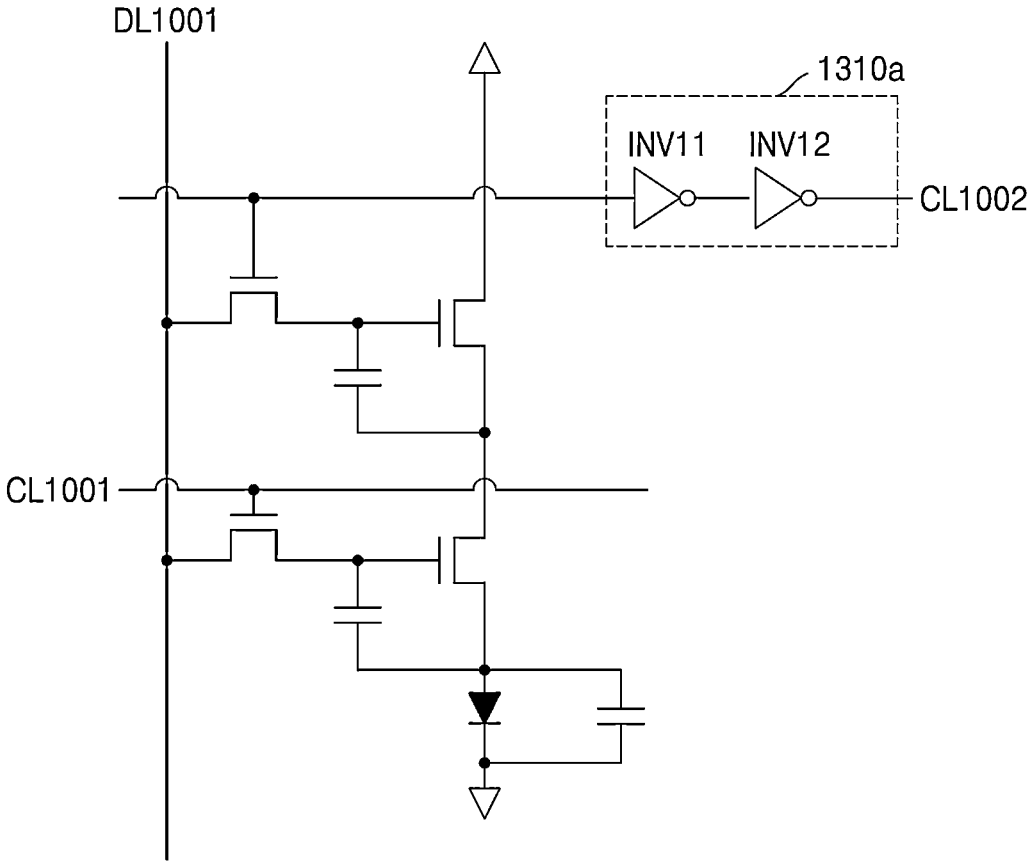
FIG. 13 is a diagram illustrating a configuration of a timing controller (1310*a*) according to an embodiment of the present disclosure.

FIG. 13 is a diagram illustrating a configuration of a timing controller 1310*a* according to an embodiment of the present disclosure.

Figure 14:
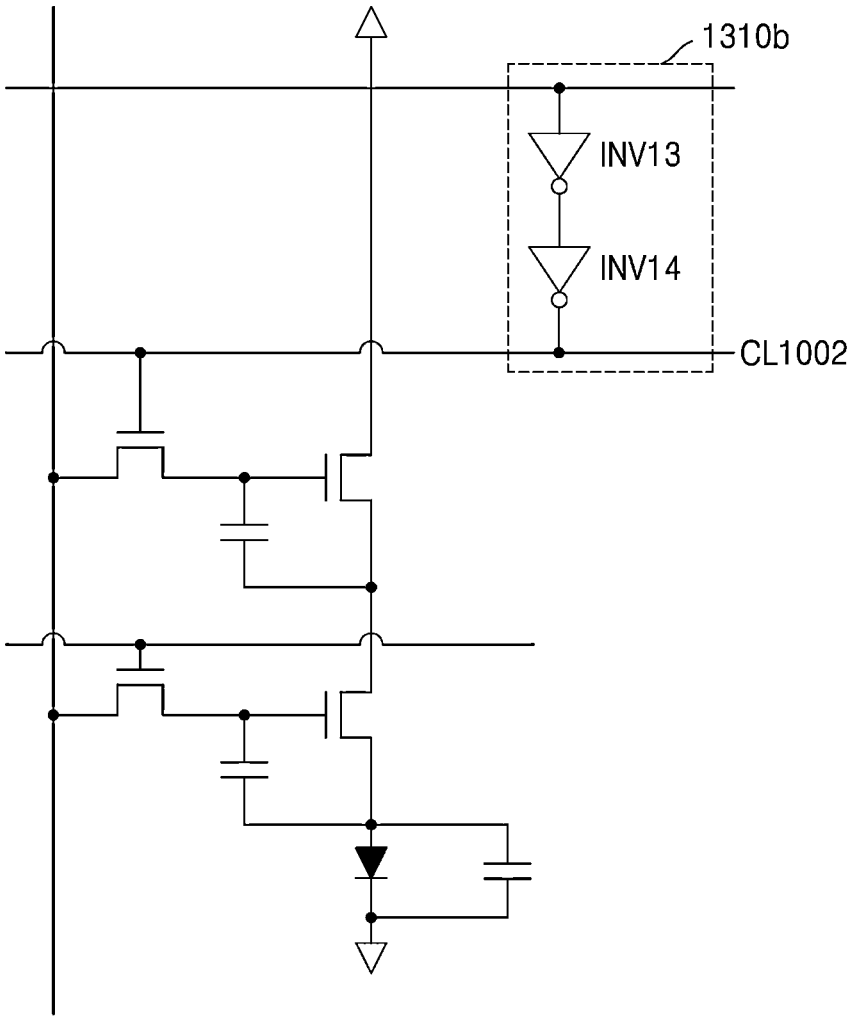
FIG. 14 is a diagram illustrating a configuration of a timing controller (1310*b*) according to another embodiment of the present disclosure.

FIG. 14 is a diagram illustrating a configuration of a timing controller 1310*b* according to another embodiment of the present disclosure.

Similar to the inverter circuits INV1 to INV4 of the timing controllers 810*a* and 810*b* of FIGS. 8 and 9, inverter circuits INV11, INV12, INV13, and INV14 of timing controllers 1310*a* and 1310*b* of FIGS. 13 and 14 may be connected in series to a tenth-second gate line CL1002 or between the tenth-second gate line CL1002 and other control lines.

As described above, the display device 1 according to the present embodiment includes: a pixel circuit 10*a* including a light-emitting element EL1, a PWM controller 310*b* for switching whether to supply current to the light-emitting element EL1, and a constant current controller 320*b* of a source follower type for supplying current to the light-emitting element EL1, wherein the PWM controller 310*b*, the constant current controller 320*b*, and the light-emitting element EL1 are connected in series between a first power line Vdd and a second power line Vss to supply current to the light-emitting element EL1; and a tenth-third transistor Tr1003 provided between the first power line Vdd and the constant current controller 320*b* to turn off the light-emitting element EL1 in a constant current setting period.

Due to the above configuration, a light-emitting device may be in the non-emission state in the constant current setting period through a simple circuit construction.

Alternatively, the display device 1 according to the present embodiment may include a pixel circuit 10*b* including: a light-emitting element EL1; a constant current controller 320*b* including a tenth-first transistor Tr1001, a tenth-first capacitor C1001 having a terminal connected to a gate terminal of the tenth-first transistor Tr1001 and another terminal connected to a source terminal of the tenth-first transistor Tr1001, and a tenth-second transistor Tr1002 having a source terminal connected to the gate terminal of the tenth-first transistor Tr1001 and a terminal of the tenth-first capacitor C1001, a gate terminal connected to the tenth-first gate line CL1001, and a drain terminal connected to a data line DL1001, and configured to supply current to the light-emitting element EL1; and a PWM controller 310 including a tenth-third transistor Tr1003, a tenth-second capacitor C1002 having a terminal connected to a gate terminal of the tenth-third transistor Tr1003, and a tenth-fourth transistor Tr1004 having a source terminal connected to the gate terminal of the tenth-third transistor Tr1003 and a terminal of the tenth-second capacitor C1002, a gate terminal connected to the tenth-second gate line CL1002, and a drain terminal connected to the data line DL1001, and configured to switch whether to supply current to the light-emitting element EL1 and to turn off the light-emitting element EL1 in a constant current setting period (times t1101 to t1107). The tenth-third transistor Tr1003, the tenth-first transistor Tr1001, and the light-emitting element EL1 may be sequentially connected in series between a first power line Vdd and a second power line Vss to supply current to the light-emitting element EL1.

Due to the above configuration, each pixel circuit may be configured with a minimum number of elements and a minimum number of gate lines, and the precision and degree of details of an image may be increased.

The display device 1 according to the present embodiment may further include a timing controller 1310*a* including an inverter circuit INV or a switching element and connected to the tenth-second gate line CL1002.

Due to the above configuration, the dullness of pulses supplied to the tenth-second gate line CL1002 may be shaped in a sub-frame period to align timing of the pulses.

A driving circuit according to the present embodiment may include a pixel circuit 10*b* including: a light-emitting element EL1; a constant current controller 320*b* including a tenth-first transistor Tr1001, a tenth-first capacitor C1001 having a terminal connected to a gate terminal of the tenth-first transistor Tr1001 and another terminal connected to a source terminal of the tenth-first transistor Tr1001, and a tenth-second transistor Tr1002 having a source terminal connected to the gate terminal of the tenth-first transistor Tr1001 and a terminal of the tenth-first capacitor C1001, a gate terminal connected to the tenth-first gate line CL1001, and a drain terminal connected to a data line DL1001, and configured to supply current to the light-emitting element EL1; and a PWM controller 310 including a tenth-third transistor Tr1003, a tenth-second capacitor C1002 having a terminal connected to a gate terminal of the tenth-third transistor Tr1003, and a tenth-fourth transistor Tr1004 having a source terminal connected to the gate terminal of the tenth-third transistor Tr1003 and a terminal of the tenth-second capacitor C1002, a gate terminal connected to the tenth-second gate line CL1002, and a drain terminal connected to the data line DL1001, and configured to switch whether to supply current to the light-emitting element EL1 and to turn off the light-emitting element EL1 in a constant current setting period (times t1101 to t1107). The tenth-third transistor Tr1003, the tenth-first transistor Tr1001, and the light-emitting element EL1 may be sequentially connected in series between a first power line Vdd and a second power line Vss to supply current to the light-emitting element EL1.

Due to the above configuration, each pixel circuit may be configured with a minimum number of elements and a minimum number of gate lines, thereby further realizing high precision and a high degree of details of an image. In a driving method of the display device 1 according to the present embodiment, which includes a pixel circuit 10*b* including: a light-emitting element EL1; a constant current controller 320*b* including a tenth-first transistor Tr1001, a tenth-first capacitor C1001 having a terminal connected to a gate terminal of the tenth-first transistor Tr1001 and another terminal connected to a source terminal of the tenth-first transistor Tr1001, and a tenth-second transistor Tr1002 having a source terminal connected to the gate terminal of the tenth-first transistor Tr1001 and a terminal of the tenth-first capacitor C1001, a gate terminal connected to the tenth-first gate line CL1001, and a drain terminal connected to a data line DL1001, and configured to supply current to the light-emitting element EL1; and a PWM controller 310 including a tenth-third transistor Tr1003, a tenth-second capacitor C1002 having a terminal connected to a gate terminal of the tenth-third transistor Tr1003, and a tenth-fourth transistor Tr1004 having a source terminal connected to the gate terminal of the tenth-third transistor Tr1003 and a terminal of the tenth-second capacitor C1002, a gate terminal connected to the tenth-second gate line CL1002, and a drain terminal connected to the data line DL1001, and configured to switch whether to supply current to the light-emitting element EL1 and to turn off the light-emitting element EL1 in a constant current setting period (times t1101 to t1107), wherein the tenth-third transistor Tr1003, the tenth-first transistor Tr1001, and the light-emitting element EL1 are sequentially connected in series between a first power line Vdd and a second power line Vss to supply current to the light-emitting element EL1, the tenth-third transistor Tr1003 may be initialized after the start of the constant current setting period (time t1102) and returned to a state before constant current setting period before the start of a sub-frame period (time t1107).

Due to the above configuration, each pixel circuit may be configured with a minimum number of elements and a minimum number of gate lines, thereby further realizing high precision and a high degree of details of an image.

In the driving method of the display device 1 according to the present embodiment, the tenth-third transistor Tr1003 may be set to the conducting state when a gate-source voltage of the tenth-first transistor Tr1001 is set.

Figure 15:
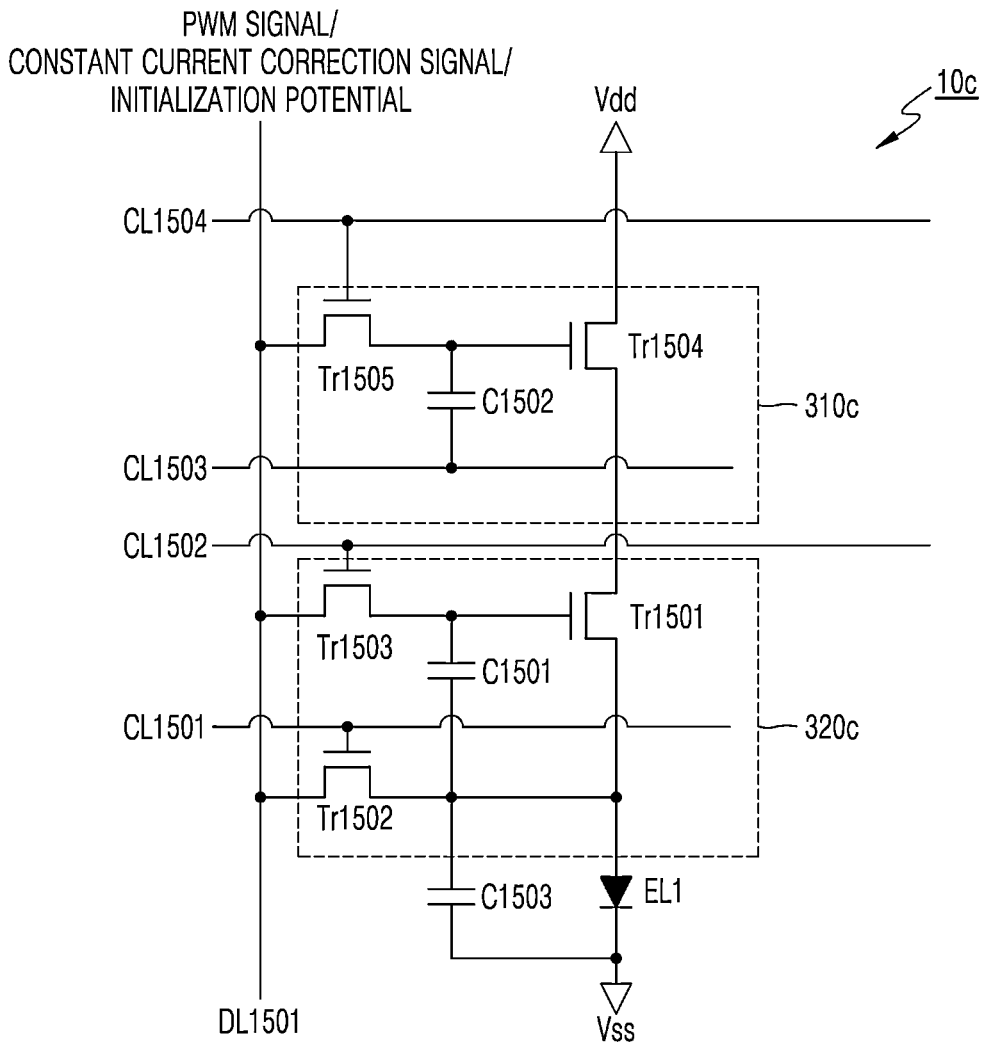
FIG. 15 is a diagram illustrating a pixel circuit according to another embodiment of the present disclosure.

FIG. 15 is a diagram illustrating a pixel circuit according to another embodiment of the present disclosure.

A display device 1 according to another embodiment of the present disclosure is, for example, an active matrix self-emitting display such as an organic EL display or an LED display, in which a PWM controller 310*c*, a constant current controller (constant current source) 320*c*, and a light-emitting element EL1 are sequentially connected in series and power lines are commonly connected to a plurality of pixel circuits 10*c* so as to perform gradation representation by driving a light-emitting element with constant current and through pulse width modulation.

A pixel circuit 10*c* includes the light-emitting element EL1, the constant current controller 320*c*, and the PWM controller 310*c*.

The constant current controller 320*c* includes three transistors and one capacitor, i.e., a fifteenth-first transistor TR1501, a fifteenth-second transistor TR1502, a fifteenth-third transistor TR1503, and a fifteenth-first capacitor C1501. The PWM controller 310*c* includes two transistors and one capacitor, i.e., a fifteenth-fourth transistor TR1504, a fifteenth-fifth transistor TR1505, and a fifteenth-second capacitor C1502.

The constant current controller 320*c* performs constant current setting, and the PWM controller 310*c* controls switching between two states, i.e., an emission state and a non-emission state, of the light-emitting element EL1.

A display device 1 and a driving method thereof according to another embodiment of the present disclosure will be described with reference to the drawings.

First, a configuration of the display device 1 according to the present embodiment will be described.

An illustration and description of the display device 1 and a horizontal control circuit 30 according to the present embodiment are omitted here, because schematic configurations thereof are similar to those of the display device 1 and the horizontal control circuit 30 of FIGS. 1 and 2 except that a fifteenth-fourth gate line CL1504 is added. The display device 1 may further include a power control circuit that supplies a power supply voltage to a power line.

FIG. 15 is a circuit diagram illustrating a configuration of a pixel circuit 10*c* according to another embodiment of the present disclosure.

The pixel circuit 10*c* includes a light-emitting element EL1, a constant current controller 320*c*, and a PWM controller 310*c*. The constant current controller 320*c* includes a fifteenth-first transistor Tr1501, a fifteenth-second transistor Tr1502, a fifteenth-third transistor Tr1503, and a fifteenth-first capacitor C1515, and the PWM controller 310*c* includes a fifteenth-fourth transistor Tr1504, a fifteenth-fifth transistor Tr1505, and a fifteenth-second capacitor C1502. That is, the pixel circuit 10*c* includes one light-emitting element, five transistors, and two capacitors (5Tr2C).

Each transistor of the pixel circuit 10*c* may be, for example, an n type thin-film transistor (TFT). Each pixel includes a plurality of sub-pixels, and each of the sub-pixels corresponds to one pixel circuit 10*c*. The sub-pixels correspond to a plurality of color components. A combination of a plurality of color components may be determined in various ways and may include, for example, R, G and B color components. According to an embodiment, the pixel circuit may include an R sub-pixel, a G sub-pixel, and a B sub-pixel.

Here, the light-emitting element EL1 is a light-emitting diode EL having general capacitive characteristics (capacitance component C3) and is also used as a capacitive device. The pixel circuit 10*a* may include a corresponding capacitor separately from the light-emitting diode EL1 when the light-emitting diode EL1 does not include the capacitive component C3. A cathode terminal (another terminal) of the light-emitting diode EL1 is electrically connected to a second power line Vss, and an anode terminal (one terminal) thereof is electrically connected to a source terminal of the fifteenth-first transistor Tr1501 and a source terminal of the fifteenth-second transistor Tr1502.

The fifteenth-first transistor Tr1501 is a transistor that controls the supply of current to the light-emitting diode EU, and a gate terminal thereof is electrically connected to a source terminal of the fifteenth-third transistor Tr1503 and a terminal of the fifteenth-first capacitor C1515, a source terminal thereof is electrically connected to the anode terminal of the light-emitting diode EL1, another terminal of the fifteenth-first capacitor C1501, and the source terminal of the fifteenth-second transistor Tr1502, and a drain terminal thereof Is electrically connected to a source terminal of the fifteenth-fourth transistor Tr1504 and another terminal of the fifteenth-second capacitor C1502.

The fifteenth-second transistor Tr1502 is a transistor that controls timing of receiving a signal according to initialization of the fifteenth-first transistor Tr1501 (or the fifteenth-first capacitor C1501) from a data line DL1, and a gate terminal thereof is electrically connected to a first gate line CL1501, a drain terminal thereof is electrically connected to the data line DL1, and a source terminal thereof is electrically connected to the source terminal of the fifteenth-first transistor Tr1501, another terminal of the fifteenth-first capacitor C1501, and the anode terminal of the light-emitting diode EL1.

The fifteenth-third transistor Tr1503 is a transistor that controls timing of receiving a signal according to constant current setting from the data line DL1, and a gate terminal thereof is electrically connected to a second gate line CL1502, a drain terminal thereof is electrically connected to the data line DL1, and a source terminal thereof is electrically connected to the gate terminal of the fifteenth-first transistor Tr1501 and one terminal of the fifteenth-first capacitor C1501.

The fifteenth-first capacitor C1501 is an element that holds a gate potential Vg of the fifteenth-first transistor Tr1501, and one terminal thereof is electrically connected to the gate terminal of the fifteenth-first transistor Tr1501 and the source terminal of the fifteenth-third transistor Tr1503 and another terminal thereof is electrically connected to the anode terminal of the light-emitting diode EL1, the source terminal of the fifteenth-first transistor Tr1501, and the source terminal of the fifteenth-second transistor Tr1502.

The fifteenth-fourth transistor Tr1504 is a transistor that switches whether to supply current to the light-emitting diode EL1, and a gate terminal thereof is electrically connected to a source terminal of the fifteenth-fifth transistor Tr1505 and a terminal of the fifteenth-second capacitor C1502, a source terminal thereof is electrically connected to the drain terminal of the fifteenth-first transistor Tr1501, and a drain terminal thereof is electrically connected to the first power line Vdd.

The fifteenth-fifth transistor Tr1505 is a transistor that controls timing of receiving a PWM signal from the data line DL1, and a gate terminal thereof is electrically connected to the fifteenth-fourth gate line CL1504, a drain terminal thereof is electrically connected to the data line DL1501, and a source terminal thereof is electrically connected to the gate terminal of the fifteenth-fourth transistor Tr1504 and one terminal of the fifteenth-second capacitor C1502.

The fifteenth-second capacitor C1502 is an element that holds a gate potential Vg of the fifteenth-fourth transistor Tr1504, that is, data of the PWM controller 310C, and one terminal thereof is electrically connected to the gate terminal of the fifteenth-fourth transistor Tr1504 and the source terminal of the fifteenth-fifth transistor Tr1505 and another terminal thereof is electrically connected to the fifteenth-third gate line CL1503. In an embodiment of the present disclosure, the fifteenth-second capacitor C1502 continues to hold the data of the PWM controller 310*c* through a constant current setting period described below.

In the display device 1 of the present embodiment, the fifteenth-fourth transistor Tr1504, the fifteenth-first transistor Tr1501, and the light-emitting diode EL1 are sequentially and electrically connected in series between the first power line Vdd and the second power line Vss. to supply current to the light-emitting diode EL1. The first power line Vdd and the second power line Vss may be commonly provided for R, G and B pixel circuits 10*c*.

Next, an operation of the display device 1 according to another embodiment of the present disclosure, that is, a driving method of the display device 1, will be described focusing on a constant current setting method.

Constant current setting of the display device 1 according to the present embodiment is performed in a constant current setting period when one frame is divided into a constant current setting period and a plurality of sub-frame periods (lighting periods). The constant current setting period is provided, for example, in a horizontal blanking period, but may be provided only in one of horizontal blanking periods of a plurality of frames.

Figure 16:
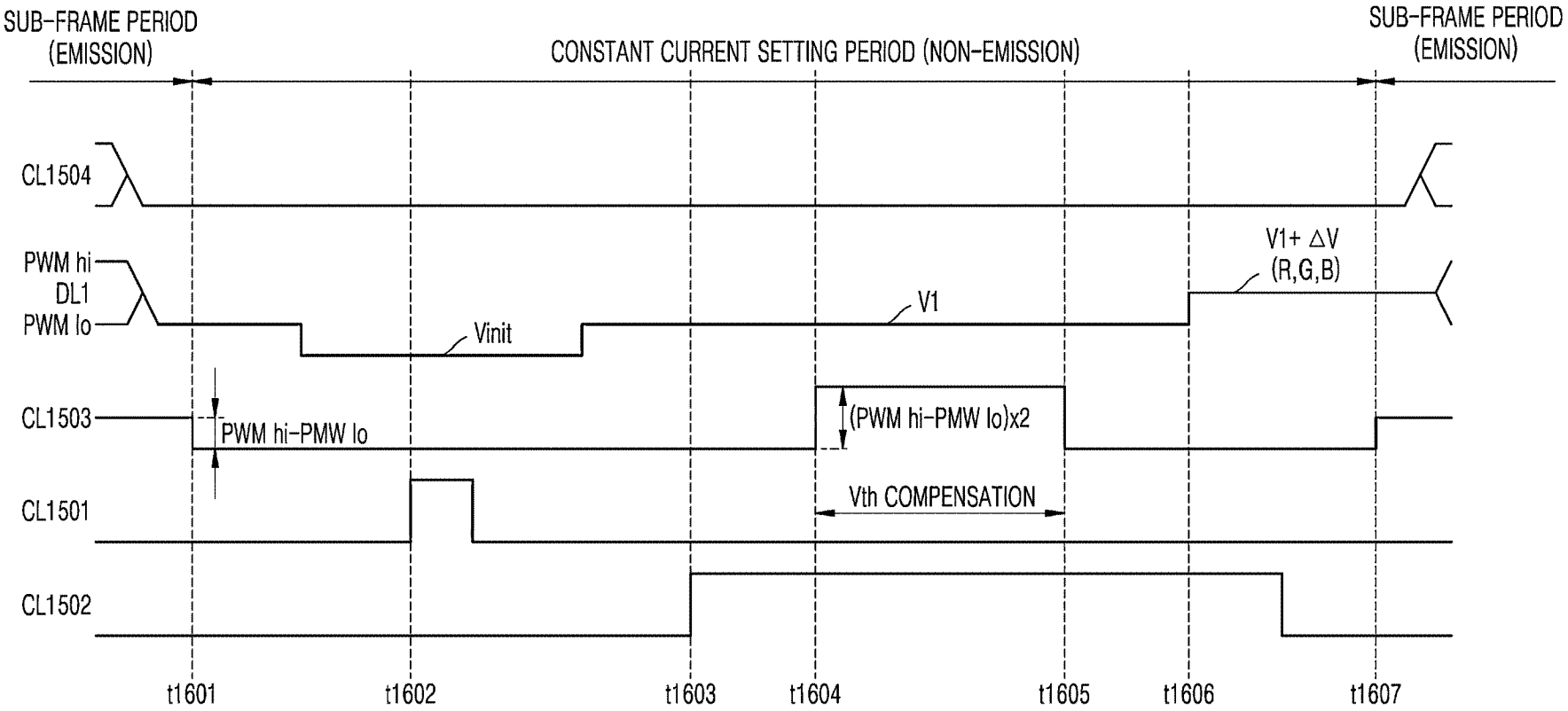
FIG. 16 is a timing chart for describing a driving method of the display device (1) according to another embodiment of the present disclosure.

FIG. 16 is a timing chart for describing a driving method of the display device 1 according to another embodiment of the present disclosure. The first power line Vdd and the second power line Vss are set to a fixed potential through one frame period, and an illustration thereof is omitted here.

FIGS. 17 to 21 are diagrams illustrating driving states of the pixel circuit 10*c* of the present embodiment at times t1601, t1602, t1604, t1606, and t1607.

Figure 17:
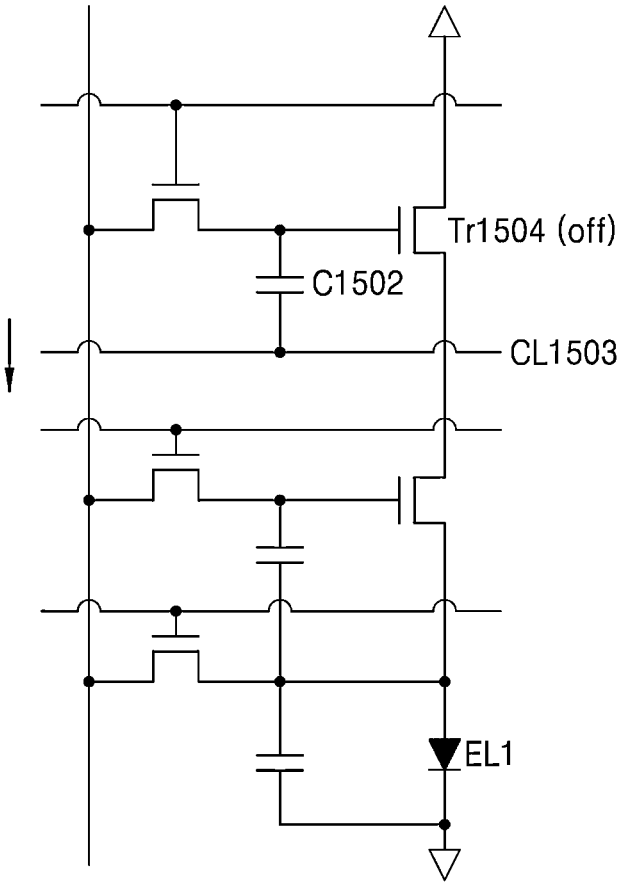
FIG. 17 is a diagram illustrating a driving state of a pixel circuit (10*c*) according to another embodiment of the present disclosure.

When a constant current setting period begins, first, a potential of the fifteenth-third gate line CL1503 is lowered to cause the fifteenth-fourth transistor Tr1504 to be in the non-conducting state ("off" state) through a capacitance coupling operation by the fifteenth-second capacitor C1502, thereby turning off the light-emitting diode EL1 (time t1601, FIG. 17). In this case, the potential of the fifteenth-third gate line CL1503 is reduced to at least an amplitude (PWM hi-PWM lo) of a PWM signal or more to cause the fifteenth-fourth transistor Tr1504 to be in the non-conducting state, not based on on/off information held by the fifteenth-second capacitor C1502.

Figure 18:
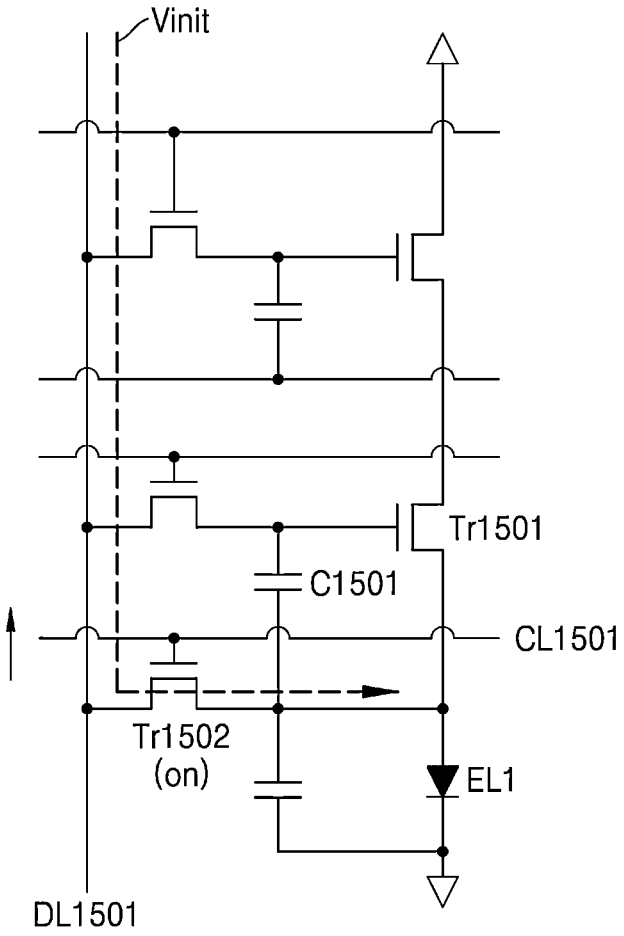
FIG. 18 is a diagram illustrating a driving state of the pixel circuit (10*c*) according to another embodiment of the present disclosure.

Next, a potential of the fifteenth-first gate line CL1501 is set to a high level (hereinafter, referred to as "H") to cause the fifteenth-second transistor Tr1502 to be in the conducting state ("on" state), an initialization potential Vinit of an analog signal converted from a digital signal is input from the data line DL1501, and a potential at a source of the first capacitor C1501, i.e., the fifteenth-first transistor Tr1501, is initialized (time t1602, FIG. 18). In this case, the initialization potential is set to a sufficiently low value to maintain the turning off of the light-emitting diode EL1 even after constant current control is performed as described below.

Figure 19:
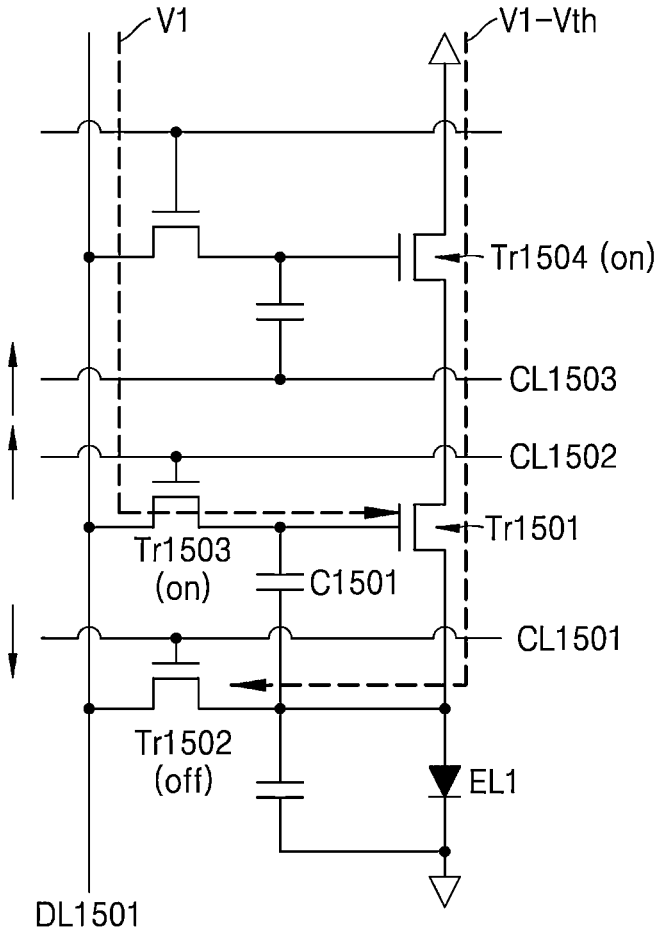
FIG. 19 is a diagram illustrating a driving state of the pixel circuit (10*c*) according to another embodiment of the present disclosure.

Next, after the potential of the fifteenth-first gate line CL1501 is set to a low level (hereinafter referred to as "L") to cause the fifteenth-second transistor Tr1502 to be in the non-conducting state, a potential of the fifteenth-second gate line CL1502 is set to H to cause the fifteenth-third transistor Tr1503 to be in the conducting state, an reference potential V1 of an analog signal from the data line DL1501 before constant current setting is written to a gate of the fifteenth-first transistor Tr1501 (time t1603), and the potential of the fifteenth-third gate line CL1503 is increased to force the fifteenth-fourth transistor Tr1504 to be in the conducting state (time t1604, FIG. 19).

Accordingly, current flows through the fifteenth-fourth transistor Tr1504 and the fifteenth-first transistor Tr1501, and thus the fifteenth-first transistor Tr1501 may compensate for a source follower threshold (Vth compensation) and a potential (V1-Vth) appears at the source terminal of the fifteenth-first transistor Tr1501 after a sufficient time period. Here, Vth represents a threshold voltage of the fifteenth-first transistor Tr1501. Furthermore, the fifteenth-first capacitor C1515 is charged to hold the threshold voltage Vth of the fifteenth-first transistor Tr1501 in the fifteenth-first capacitor C1501.

At time t1604, the potential of the fifteenth-third gate line CL1503 may be increased to twice the amplitude of the PWM signal, i.e., (PWM hi-PWM lo)X2, so that the fifteenth-fourth transistor Tr1504 may be in the conducting state regardless of holding information of the fifteenth-second capacitor C1525.

Figure 20:
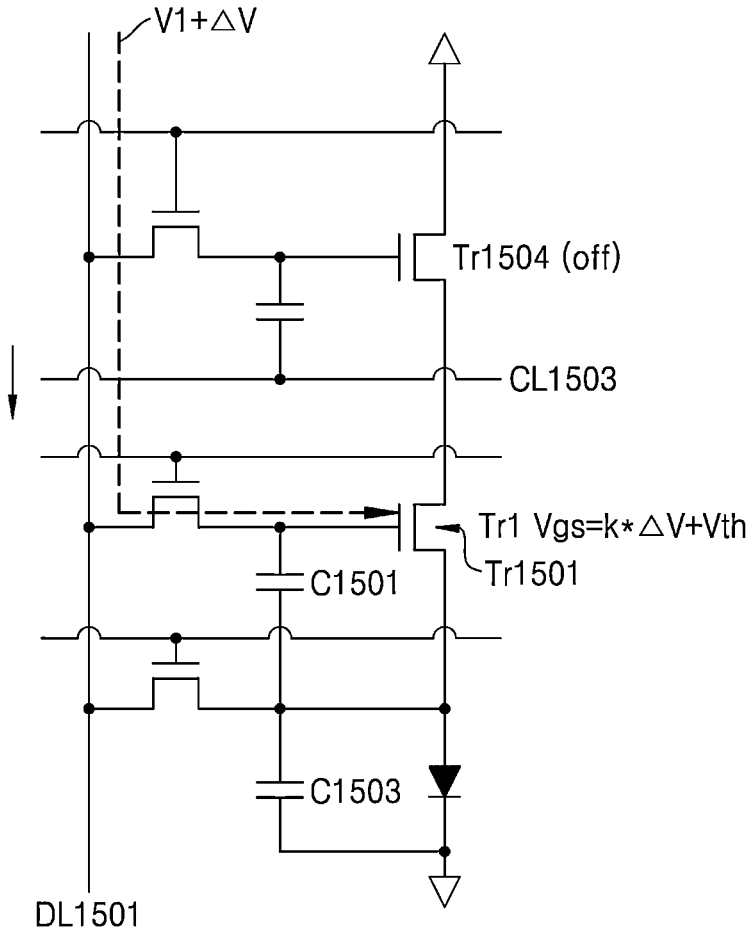
FIG. 20 is a diagram illustrating a driving state of the pixel circuit (10*c*) according to another embodiment of the present disclosure.

Then, after taking a sufficient time to compensate for or detect the threshold voltage Vth of the fifteenth-first transistor Tr1501, the potential of the fifteenth-third gate line CL1503 is set to L to force the fifteenth-fourth transistor Tr1504 to be in the non-conducting state, thereby stopping the supply of current (time t1605), and a potential (V1+ΔV) of an analog signal from the data line DL1 is written to the gate of the fifteenth-first transistor Tr1501, and a potential of a terminal of the fifteenth-first capacitor C1515 is increased by a potential ΔV corresponding to constant current, thereby performing constant current control of the constant current controller 320*c* (time t1606, FIG. 20).

In this case, because a terminal of the fifteenth-first capacitor C1501 is connected in series to the capacitance component C1503 of the light-emitting element EL1, a voltage applied to the fifteenth-first capacitor C1501 is Vth+ΔVXC1501/(C1501+C1502). That is, the gate-source voltage Vgs of the fifteenth-first transistor Tr1501 is Vth+ΔVXC1501/(C1501+C1502), and a current value when the fifteenth-first transistor Tr1501 is operated in a saturation region does not depend on the threshold voltage Vth, thereby canceling an influence of a fluctuation of the threshold voltage Vth due to non-uniform characteristics of the fifteenth-first transistor Tr1501.

Figure 21:
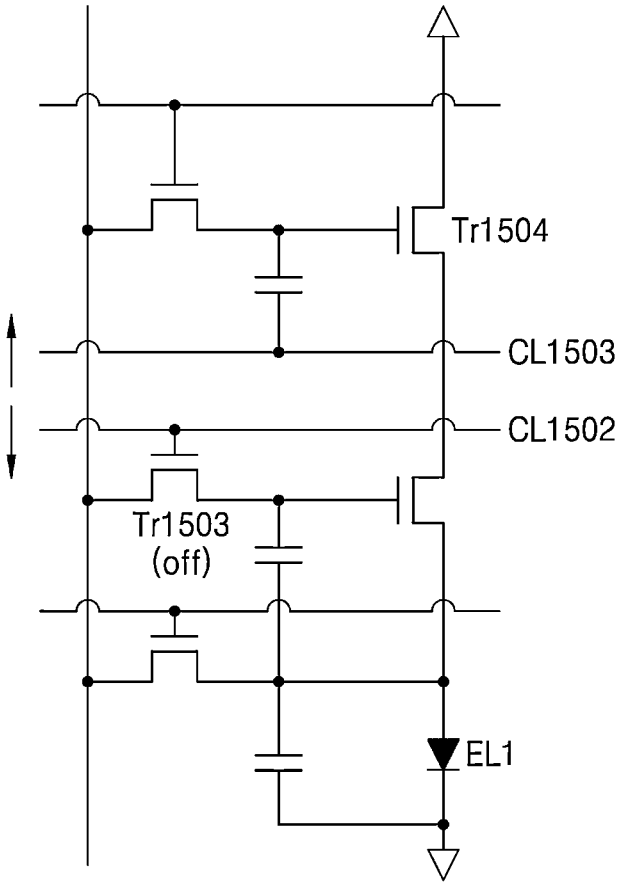
FIG. 21 is a diagram illustrating a driving state of the pixel circuit (10*c*) according to another embodiment of the present disclosure.

Then, after the potential of the second gate line CL1502 is set to L to cause the fifteenth-third transistor Tr1503 to be in the non-conducting state, and the potential of the fifteenth-third gate line CL1503 is returned to a value before the turning off of the light-emitting diode EL1 (time t1601) so as to restore the gate potential of the fifteenth-fourth transistor Tr1504 and resume emission of the light-emitting diode EL1 (time t1607, FIG. 21).

As described above, in the display device 1 according to the present embodiment, because the fifteenth-second transistor Tr1502 is added to the constant current controller 320*c*, a diode-connected type may be changed to a source follower type for the Vth compensation and a signal for setting constant current need not be input from a power line. Accordingly, power lines may be shared between a plurality of pixel circuits 10*c*, and an influence of a voltage drop due to wiring resistance may reduce. Both the first power line Vdd and the second power line Vss may be set to fixed potentials, thereby reducing the size of a driving circuit such as a power control circuit.

In addition, in the display device 1 of the present embodiment, all of the transistors constituting the pixel circuit 10*c* are n type transistors but may include both n-type transistors and p-type transistors or may be p-type transistors.

Figure 22:
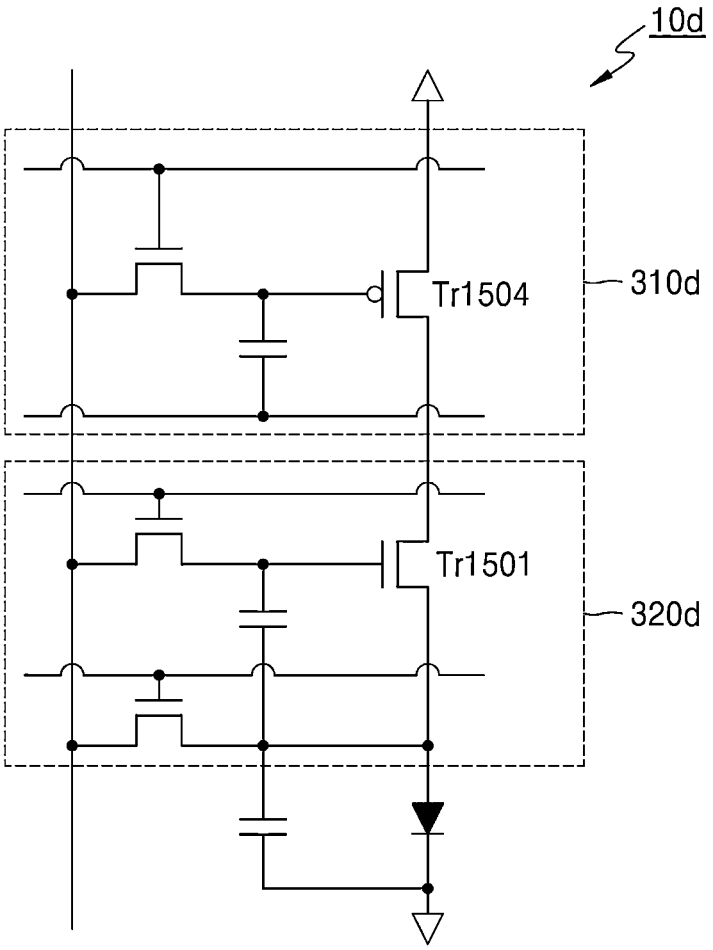
FIG. 22 is a circuit diagram illustrating a configuration of the pixel circuit (10*c*) according to another embodiment of the present disclosure.
Figure 23:
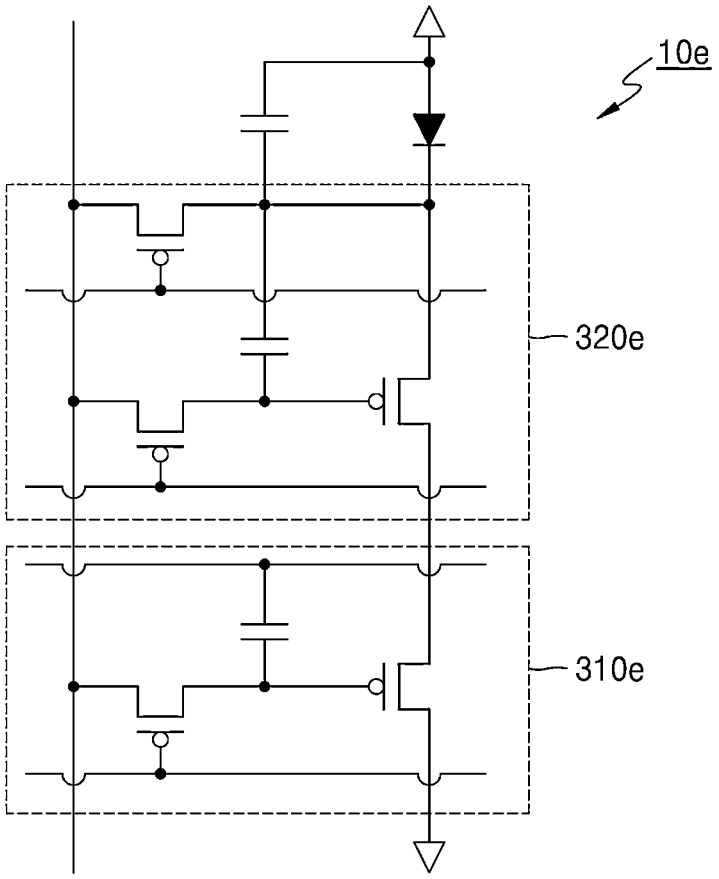
FIG. 23 is a circuit diagram illustrating a configuration of the pixel circuit (10*c*) according to another embodiment of the present disclosure.

FIGS. 22 and 23 are circuit diagram illustrating other examples of a configuration of the pixel circuit 10*c* according to the present embodiment. FIG. 22 illustrates a CMOS pixel circuit 10*d* in which only a fifteenth-fourth transistor Tr1504 is a p type transistor and the other transistors are n type transistors. FIG. 23 illustrates a pixel circuit 10*e* in which all transistors are p type transistors.

A fifteenth-first transistor Tr1501 may be an n type (or p type) transistor and the fifteenth-fourth transistor Tr1504 is a p type (or n type) transistor, that is, the fifteenth-first transistor Tr1501 and the fifteenth-fourth transistor Tr1504 are reverse conductivity-type transistors, and thus, an amplitude of a PWM signal may be reduced to reduce power consumption of a display device.

A write time of the PWM signal by the fifteenth-fourth gate line CL1504 according to the present embodiment is very short, compared to the related art. Therefore, by connecting a timing controller including, for example, a plurality of inverter circuits or switch elements to the fifteenth-fourth gate line CL1504, the dullness of pulses supplied to the fifteenth-fourth gate line CL1504 in a sub-frame period may be shaped to align timing of the pulses.

As described above, a display device 1 according to another embodiment of the present disclosure includes a pixel circuit 10*c* including: a light-emitting element EL1; a constant current controller including a fifteenth-first transistor Tr1501, a fifteenth-first capacitor C1501 having one terminal connected to a gate terminal of the fifteenth-first transistor Tr1501 and another terminal connected to a source terminal of the fifteenth-first transistor Tr1501 and a terminal of the light-emitting element EL1, a fifteenth-second transistor Tr1502 having a source terminal connected to the source terminal of the fifteenth-first transistor Tr1501 and another terminal of the fifteenth-first capacitor C1501, a gate terminal connected to the fifteenth-first gate line CL1501, and a drain terminal connected to a data line DL1501, and a fifteenth-third transistor Tr1503 having a source terminal connected to the gate terminal of the fifteenth-first transistor Tr1501 and a terminal of the fifteenth-first capacitor C1501, a gate terminal connected to the fifteenth-second gate line CL1502, and a drain terminal connected to the data line DL1501, and configured to supply current to the light-emitting element EL1; and a PWM controller 310*c* including a fifteenth-fourth transistor Tr1504, a fifteenth-second capacitor C1502 having a terminal connected to a gate terminal of the fifteenth-fourth transistor Tr1504 and another terminal connected to the fifteenth-third gate line CL1503, and a fifteenth-fifth transistor Tr1505 having a source terminal connected to the gate terminal of the fifteenth-fourth transistor Tr1504 and a terminal of the fifteenth-second capacitor C1502, a gate terminal connected to the fifteenth-fourth gate line CL1504, and a drain terminal connected to the data line DL1501, and configured to switch whether to supply current to the light-emitting element EL1, wherein the fifteenth-fourth transistor Tr1504, the fifteenth-first transistor Tr1501, and the light-emitting element EL1 are sequentially connected in series between a first power line Vdd and a second power line Vss to supply current to the light-emitting element EL1.

Due to the above configuration, the power lines Vdd and Vss may be shared between a plurality of pixel circuits 10*c*, and an influence of potential fluctuations of the power supply lines Vdd and Vss may be greatly reduced.

In the display device 1 according to another embodiment of the present disclosure, the fifteenth-first transistor Tr1501 and the fifteenth-fourth transistor Tr1504 may be different conductivity types. Due to the above configuration, an amplitude of a PWM signal and power consumption of the display device 1 may be reduced.

A driving circuit according to the present embodiment includes a pixel circuit 10*c* including: a light-emitting element EL1; a constant current controller 320*c* including a fifteenth-first transistor Tr1501, a fifteenth-first capacitor C1501 having one terminal connected to a gate terminal of the fifteenth-first transistor Tr1501 and another terminal connected to a source terminal of the fifteenth-first transistor Tr1501 and a terminal of the light-emitting element EL1, a fifteenth-second transistor Tr1502 having a source terminal connected to the source terminal of the fifteenth-first transistor Tr1501 and another terminal of the fifteenth-first capacitor C1501, a gate terminal connected to the fifteenth-first gate line CL1501, and a drain terminal connected to a data line DL1501, and a fifteenth-third transistor Tr1503 having a source terminal connected to the gate terminal of the fifteenth-first transistor Tr1501 and a terminal of the fifteenth-first capacitor C1501, a gate terminal connected to the fifteenth-second gate line CL1502, and a drain terminal connected to the data line DL1501, and configured to supply current to the light-emitting element EL1; and a PWM controller 310*c* including a fifteenth-fourth transistor Tr1504, a fifteenth-second capacitor C1502 having a terminal connected to a gate terminal of the fifteenth-fourth transistor Tr1504 and another terminal connected to the fifteenth-third gate line CL1503, and a fifteenth-fifth transistor Tr1505 having a source terminal connected to the gate terminal of the fifteenth-fourth transistor Tr1504 and a terminal of the fifteenth-second capacitor C1502, a gate terminal connected to the fifteenth-fourth gate line CL1504, and a drain terminal connected to the data line DL1501, and configured to switch whether to supply current to the light-emitting element EL1, wherein the fifteenth-fourth transistor Tr1504, the fifteenth-first transistor Tr1501, and the light-emitting element EL1 are sequentially connected in series between a first power line Vdd and a second power line Vss to supply current to the light-emitting element EL1.

Due to the above configuration, power lines may be shared between a plurality of pixel circuits 10*c*, and an influence of potential fluctuation of the power lines may be greatly reduced.

A driving method of a display device 1 according to another embodiment is a driving method of a display device 1 including: a pixel circuit 10*c* including: a light-emitting element EL1; a constant current controller 320*c* including a fifteenth-first transistor Tr1501, a fifteenth-first capacitor C1501 having one terminal connected to a gate terminal of the fifteenth-first transistor Tr1501 and another terminal connected to a source terminal of the fifteenth-first transistor Tr1501 and a terminal of the light-emitting element EL1, a fifteenth-second transistor Tr1502 having a source terminal connected to the source terminal of the fifteenth-first transistor Tr1501 and another terminal of the fifteenth-first capacitor C1501, a gate terminal connected to the fifteenth-first gate line CL1501, and a drain terminal connected to a data line DL1501, and a fifteenth-third transistor Tr1503 having a source terminal connected to the gate terminal of the fifteenth-first transistor Tr1501 and a terminal of the fifteenth-first capacitor C1501, a gate terminal connected to the fifteenth-second gate line CL1502, and a drain terminal connected to the data line DL1501, and configured to supply current to the light-emitting element EL1; and a PWM controller 310*c* including a fifteenth-fourth transistor Tr1504, a fifteenth-second capacitor C1502 having a terminal connected to a gate terminal of the fifteenth-fourth transistor Tr1504 and another terminal connected to the fifteenth-third gate line CL1503, and a fifteenth-fifth transistor Tr1505 having a source terminal connected to the gate terminal of the fifteenth-fourth transistor Tr1504 and a terminal of the fifteenth-second capacitor C1502, a gate terminal connected to the fifteenth-fourth gate line CL1504, and a drain terminal connected to the data line DL1501, and configured to switch whether to supply current to the light-emitting element EL1, wherein the fifteenth-fourth transistor Tr1504, the fifteenth-first transistor Tr1501, and the light-emitting element EL1 are sequentially connected in series between a first power line Vdd and a second power line Vss to supply current to the light-emitting element EL1. In the driving method, the first power line Vdd and the second power line Vss are set to fixed potentials in a one frame period.

Due to the above configuration, power lines may be shared between a plurality of pixel circuits 10*c*, and an influence of potential fluctuation of the power lines may be greatly reduced.

Figure 24:
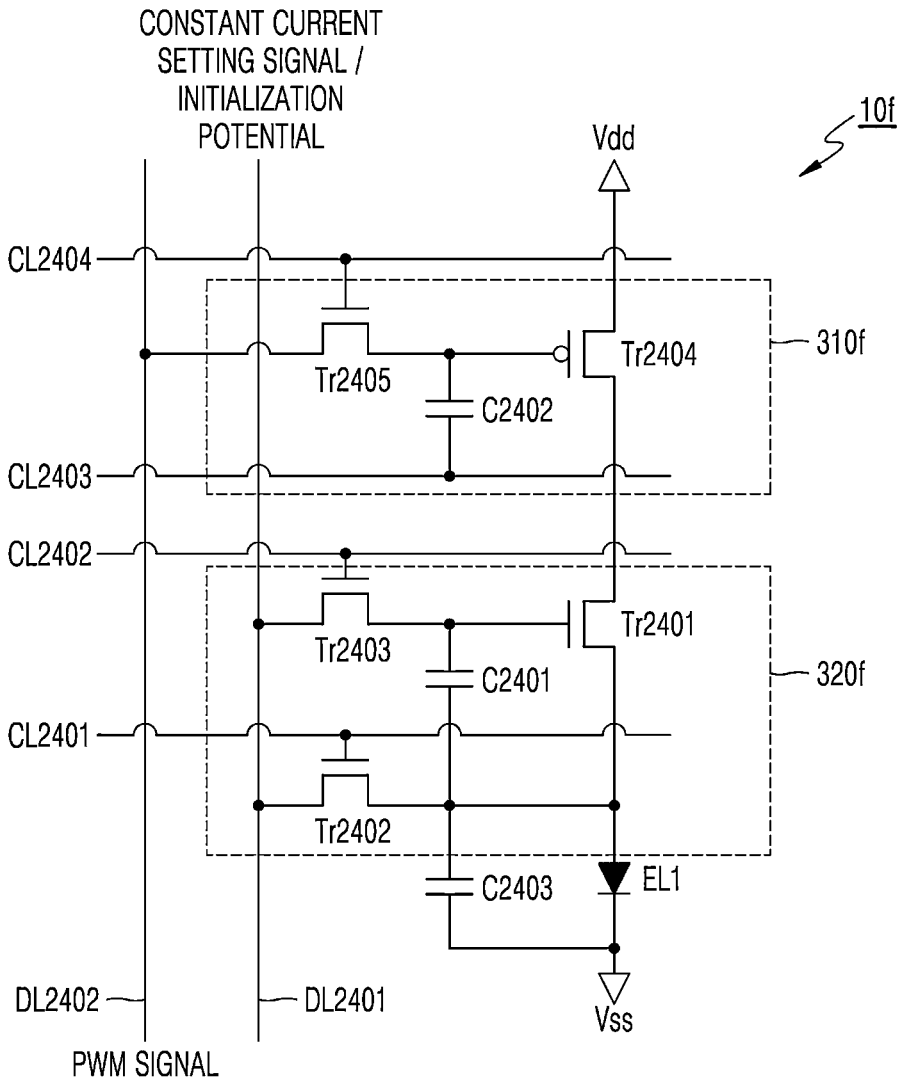
FIG. 24 is a diagram illustrating a configuration of a pixel circuit according to another embodiment of the present disclosure.

FIG. 24 is a diagram illustrating a configuration of a pixel circuit according to another embodiment of the present disclosure. A display device 1 according to another embodiment of the present disclosure is, for example, an active matrix self-emitting display, in which a PWM controller 310*f*, a constant current controller 320*f*, and a light-emitting element EL1 are serially connected between power supplies so that power lines may be shared between a plurality of pixel circuits and each of the pixel circuits may include two data lines DL2401 and DL2402 to evaluate luminous characteristics of the light-emitting element EL1.

A display device 1 and a driving method thereof according to another embodiment of the present disclosure will be described with reference to the drawings.

First, a configuration of a display device according to another embodiment of the present disclosure will be described.

A schematic configuration of the display device 1 of another embodiment of the present disclosure is the same as that of the display device 1 of the embodiment of FIG. 15, except that each pixel circuit includes two data lines DL2401 and DL2402, and thus, an illustration and description thereof are omitted here.

FIG. 24 is a circuit diagram illustrating a configuration of a pixel circuit 10*f* according to another embodiment of the present disclosure.

The pixel circuit 10*c* includes a light-emitting element EL1, a constant current controller 320*f*, and a PWM controller 310*f*. The constant current controller 320*f* includes a twenty-fourth-first transistor Tr2401, a twenty-fourth-second transistor Tr2402, a twenty-fourth-third transistor Tr2403, and a twenty-fourth-first capacitor C2401, and the PWM controller 3104 includes a twenty-fourth-fourth transistor Tr2404, a twenty-fourth-fifth transistor Tr2405, and a twenty-fourth-second capacitor C2402. That is, the pixel circuit 10*f* of the present embodiment includes one light-emitting element, five transistors, and two capacitors (5Tr2C). Each transistor of the pixel circuit 10*f* may correspond to, for example, an n type TFT.

The pixel circuit 10*f* is different from the pixel circuit 10*c* of the embodiment of FIG. 15, in that the twenty-fourth-first data line DL2401 for supplying an analog signal and the twenty-fourth-second data line DL2402 for supplying a digital signal are provided, drain terminals of the twenty-fourth-second transistor Tr2402 and the twenty-fourth-third transistor Tr2403 are electrically connected to the twenty-fourth-first data line DL2401, and a drain terminal of the twenty-fourth-fifth transistor Tr2405 is electrically connected to the twenty-fourth-second data line DL2402.

Next, an operation of the display device 1, that is, a driving method of the display device 1, according to the present embodiment will be described focusing on a constant current setting method.

Constant current setting of the display device 1 according to another embodiment of the present disclosure is performed in a constant current setting period.

Figure 25:
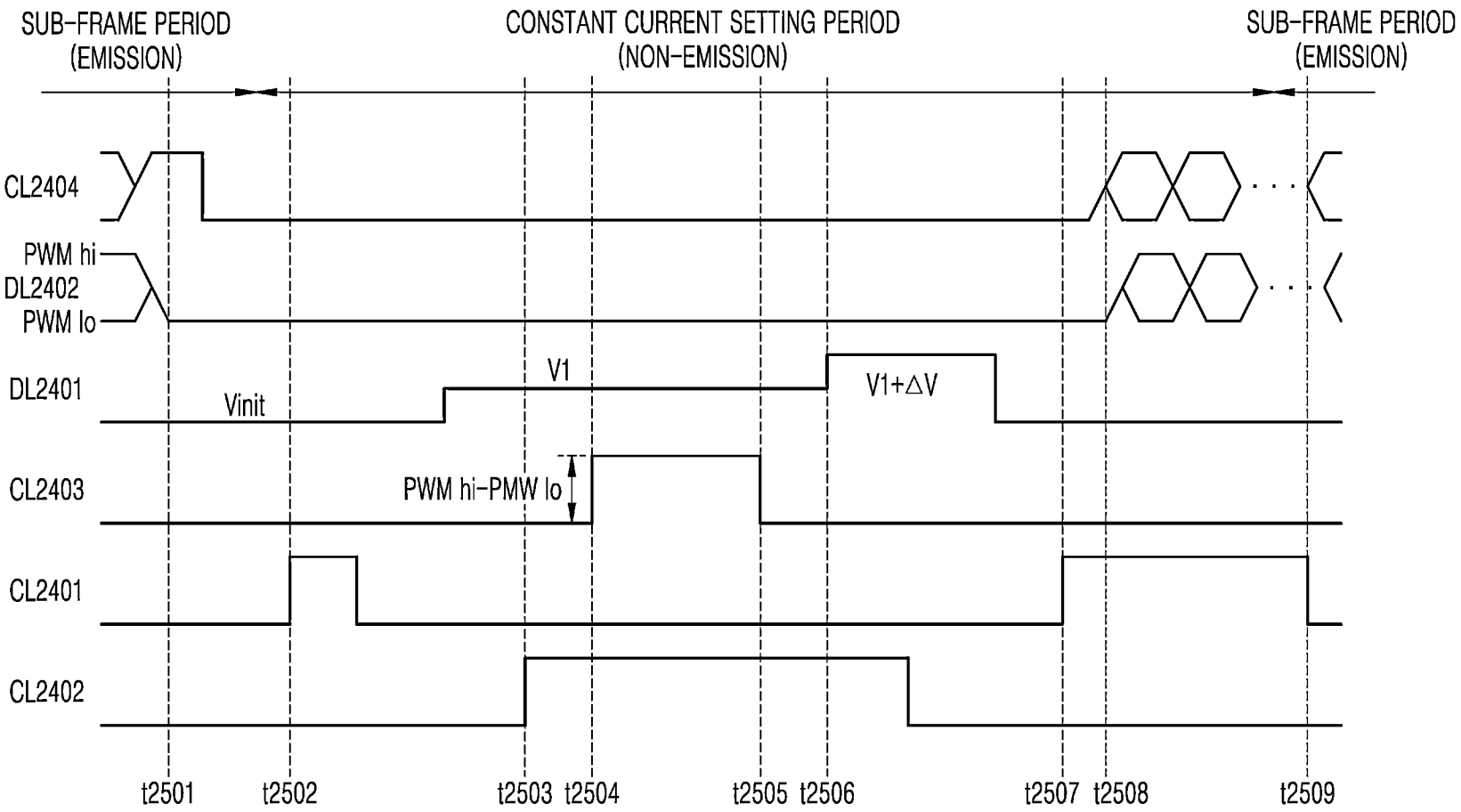
FIG. 25 is a timing chart for describing a driving method of the display device (1) according to another embodiment of the present disclosure.

FIG. 25 is a timing chart for describing a driving method of the display device 1 according to another embodiment of the present disclosure. Here, a first power line Vdd and a second power line Vss are set to fixed potentials through one frame period and thus an illustration thereof is omitted.

FIGS. 26 to 31 are diagrams illustrating driving states of the pixel circuit 10*f* at times t2501, t2502, t2504, t2506, t2508, and t2509, according to another embodiment of the present disclosure.

Figure 26:
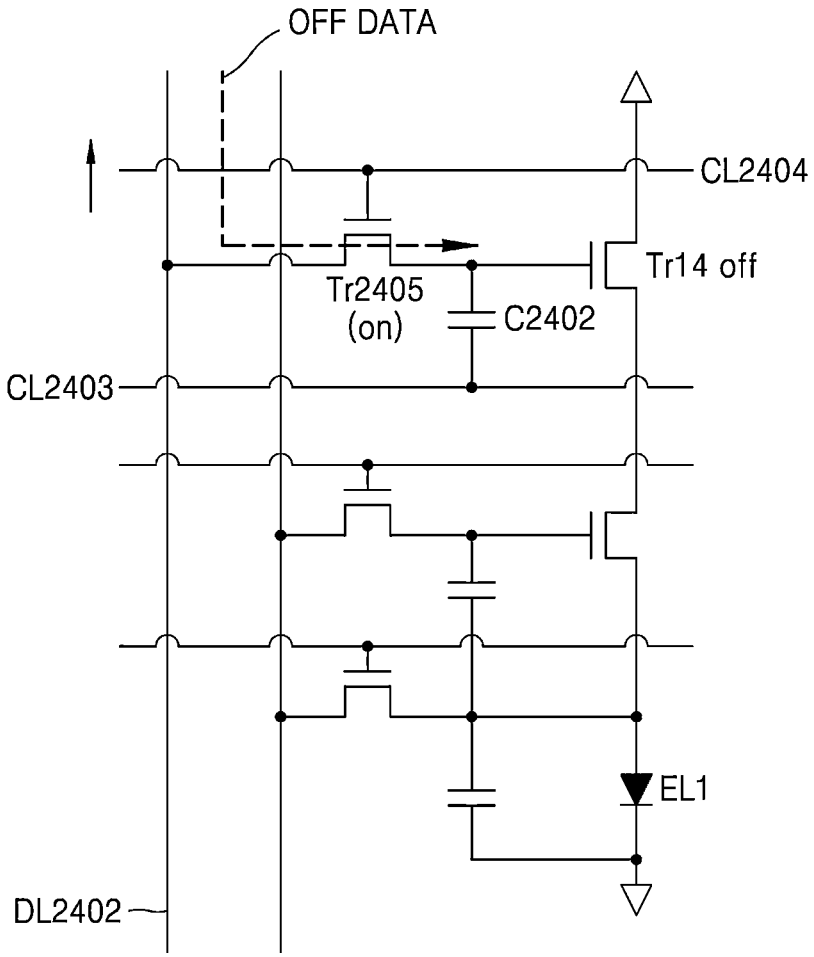
FIG. 26 is a diagram illustrating a driving state of a pixel circuit (10*f*) according to another embodiment of the present disclosure.

When a constant current setting period starts, first, a potential of a twenty-fourth-fourth gate line CL2404 is set to H to cause the twenty-fourth-fifth transistor Tr2405 to be in the conducting state, and an L potential of a digital signal from the twenty-fourth-second data line DL2402 is written to a gate of the twenty-fourth-fourth transistor Tr2404 to cause the twenty-fourth-fourth transistor Tr2404 to be in the non-conducting state and to turn off the light-emitting diode EL1 (time t2501, FIG. 26). Accordingly, on/off information of a PWM signal held by the twenty-fourth-second capacitor C2402 before the constant current setting period is lost, the twenty-fourth-fourth transistor Tr2404 is reset, and the twenty-fourth-second capacitor C2402 holes the off information.

Figure 27:
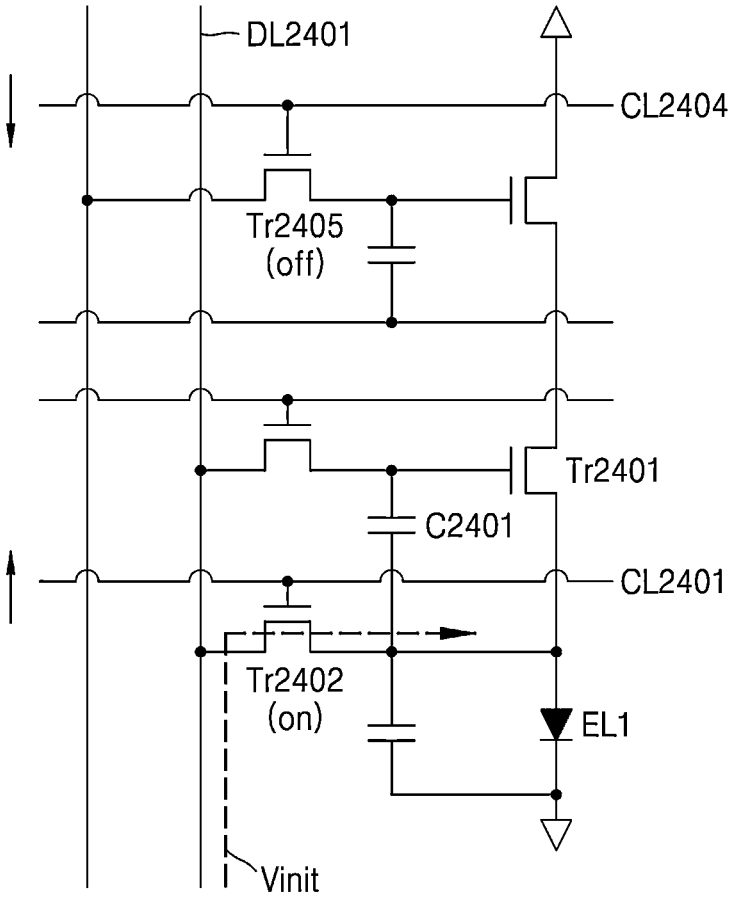
FIG. 27 is a diagram illustrating a driving state of the pixel circuit (10*f*) according to another embodiment of the present disclosure.

Next, the twenty-fourth-fourth gate line CL2404 is set to L to cause the twenty-fourth-fifth transistor Tr2405 to be in the non-conducting state, a potential of a twenty-fourth-first gate line CL2401 is set to H to cause the twenty-fourth-second transistor Tr2402 to be in the conducting state, and an initialization potential Vinit of an analog signal from the twenty-fourth-first data line DL2401 is input to initialize the twenty-fourth-first capacitor C2401, i.e., a potential at a source of the twenty-fourth-first transistor Tr2401 (time t2502, FIG. 27). In this case, the initialization potential Vinit is set to a sufficiently low value to maintain the turning off of the light-emitting diode EL1 even after constant current control is performed as described below.

Figure 28:
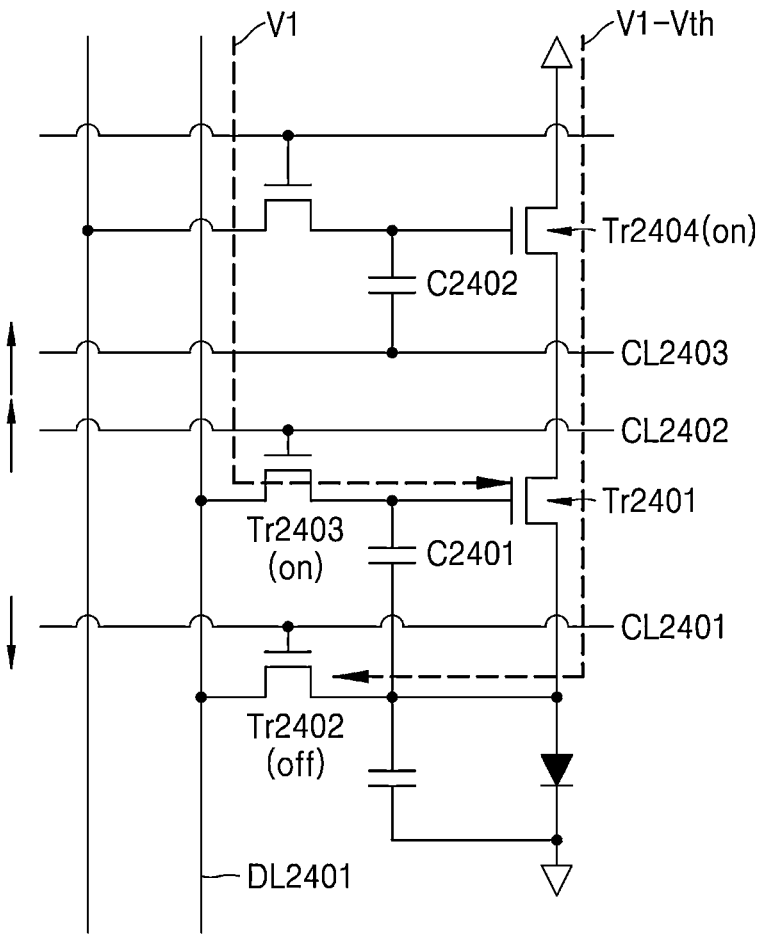
FIG. 28 is a diagram illustrating a driving state of the pixel circuit (10*f*) according to another embodiment of the present disclosure.

Thereafter, after a potential of the twenty-fourth-first gate line CL2401 is set to L to cause the twenty-fourth-second transistor Tr2402 to be in the non-conducting state, a potential of a twenty-fourth-second gate line CL2402 is set to H to cause the twenty-fourth-third transistor Tr2403 to be in the conducting state and a reference potential V1 of an analog signal from the twenty-fourth-first data line DL2401 is written to a gate of the twenty-fourth-first transistor Tr2401 (time t2503), and a potential of the twenty-fourth-third gate line CL2403 is increased to cause the twenty-fourth-fourth transistor Tr2404 to be in the conducting state (time t2504, FIG. 28).

Accordingly, current flows through the twenty-fourth-fourth transistor Tr2404 and the twenty-fourth-first transistor Tr2401, and thus, the twenty-fourth-first transistor Tr2401 may compensate for a source follower threshold (Vth compensation) and a potential (V1−Vth) appears at the source terminal of the twenty-fourth-first transistor Tr2401 after a sufficient time period. The twenty-fourth-first capacitor C1515 is charged, and a threshold voltage Vth of the twenty-fourth-first transistor Tr2401 is held in the twenty-fourth-first capacitor C2401.

At time t2504, the potential of the twenty-fourth-third gate line CL2403 may be increased to about an amplitude, i.e., PWM hi-PWM lo, of a PWM signal because the twenty-fourth-second capacitor C2402 holds the off information.

Figure 29:
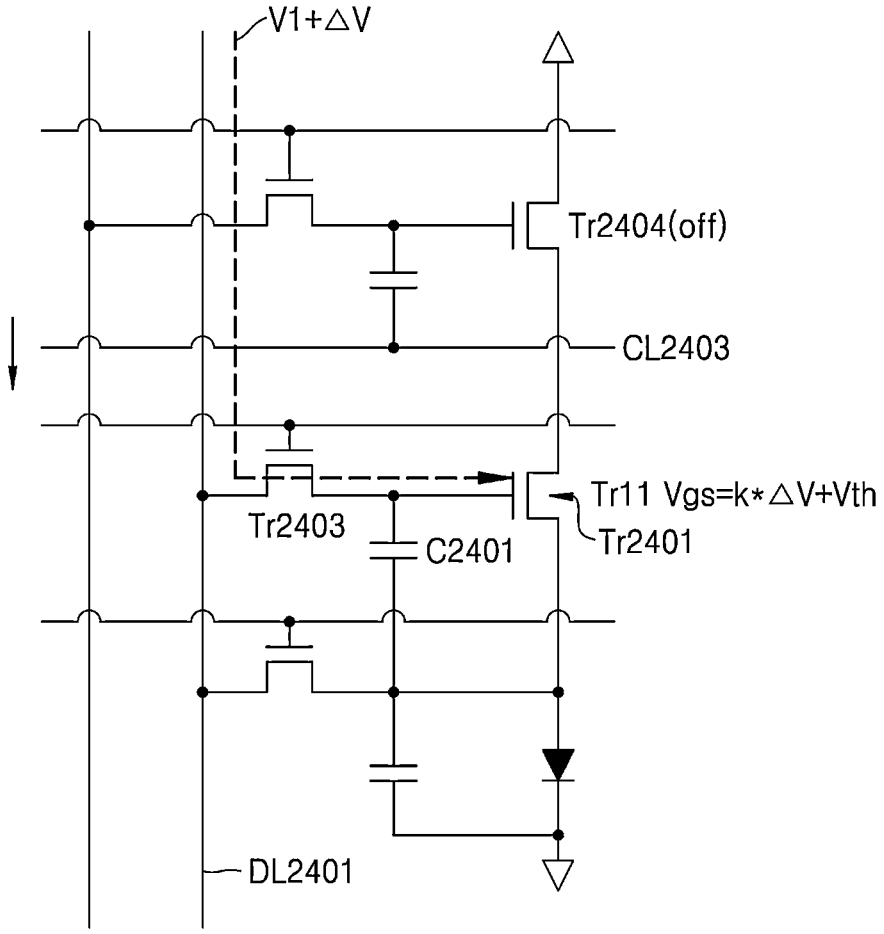
FIG. 29 is a diagram illustrating a driving state of the pixel circuit (10*f*) according to another embodiment of the present disclosure.

Then, after the threshold voltage Vth is compensated for and detected for a sufficient time, a potential of the twenty-fourth-third gate line CL2403 is set to L to cause the twenty-fourth-four transistor Tr2404 to be in the non-conducting state, thereby stopping the supply of current (time t2504), and a potential (V1+ΔV) of an analog signal from the twenty-fourth-first data line DL2401 is written to agate of the twenty-fourth-first transistor Tr2401 and a potential of a terminal of the twenty-fourth-first capacitor C2401 is increased by ΔV to perform constant current setting of the constant current controller 320*f* (time t2506, FIG. 29).

In this case, a gate-source voltage Vgs of the twenty-fourth-first transistor Tr2401 is Vth+ΔVXC2401/(C2401+C2402) and a current value when the twenty-fourth-first transistor Tr2401 is operated in a saturation region does not depend on the threshold voltage Vth, thereby canceling an influence of a fluctuation of the threshold voltage Vth due to non-uniform characteristics of the twenty-fourth-first transistor Tr2401.

Figure 30:
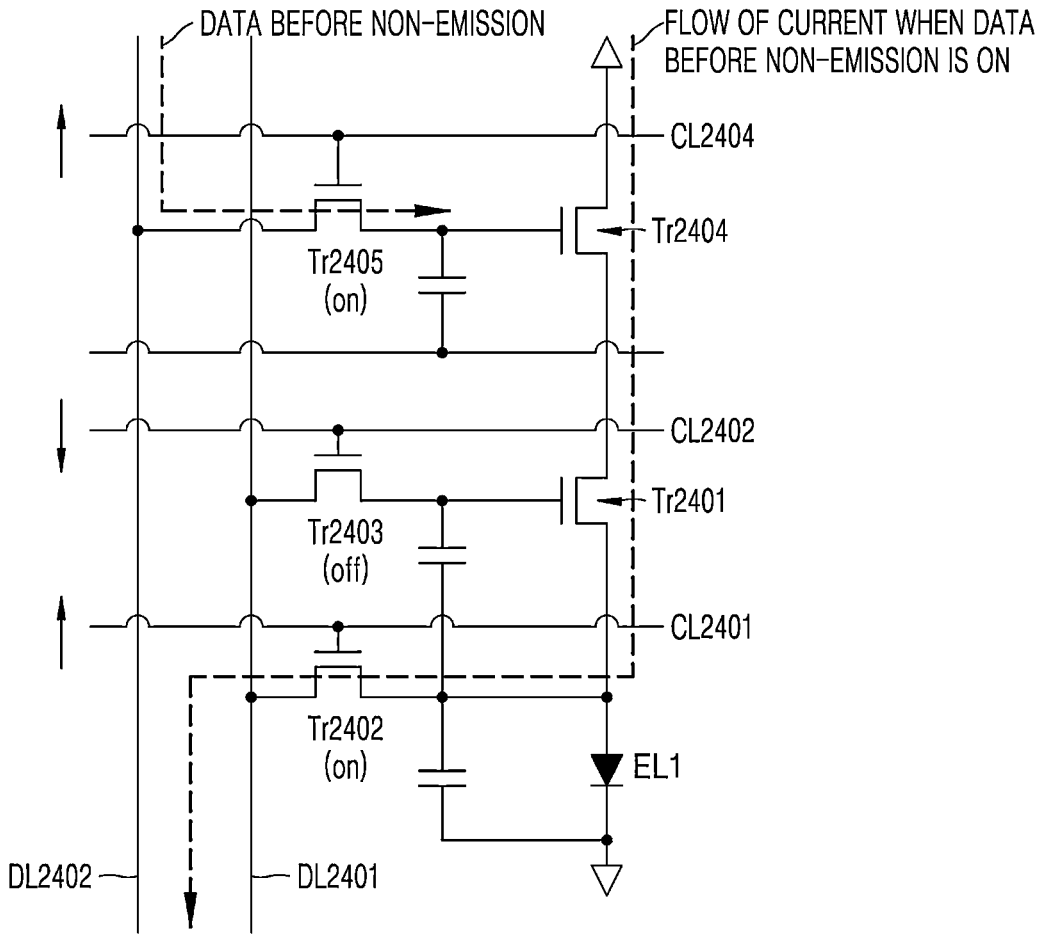
FIG. 30 is a diagram illustrating a driving state of the pixel circuit (10*f*) according to another embodiment of the present disclosure.

In addition, after a potential of the twenty-fourth-second gate line CL2402 is set to L to cause the twenty-fourth-third transistor Tr2403 to be in the non-conducting state and a potential of the twenty-fourth-first gate line CL2401 is set to H to cause the twenty-fourth-second transistor Tr2402 to be in the conducting state (time t2507), potentials of the twenty-fourth-fourth gate lines CL2404 in pixel rows are sequentially set to H to cause the twenty-fourth-fifth transistors Tr2405 in the pixel rows to be in the conducting state and a digital PWM signal is written to the twenty-fourth-fourth transistor Tr2404 to restore the twenty-fourth-fourth transistor Tr2404 to a state before resetting the twenty-fourth-fourth transistor Tr2404, i.e., a state before the constant current setting period, to prepare for emission of the light-emitting diode EL1 (time t2508, FIG. 30).

In this case, when the twenty-fourth-fourth transistor Tr2404 is in the conducting state before the constant current setting period, i.e., before the turning off of the light-emitting element EL1 (time t2501), at time t2508, the PWM signal is written to the twenty-fourth-fourth transistor Tr2404 and thus, current flows through the twenty-fourth-fourth transistor Tr2404 and the twenty-fourth-first transistor Tr2401. However, a potential of the twenty-fourth-first data line DL2401 is set to be substantially the same as a potential at a cathode of the light-emitting diode EL1 to cause an anode-cathode voltage of the light-emitting diode EL1 to be 0 V and prevent current from flowing through the light-emitting diode EL1, thereby maintaining the turning off of the light-emitting diode EL1. Because the twenty-fourth-second transistor Tr2402 is in the conducting state, current flows to the twenty-fourth-first data line DL2401 through the twenty-fourth-second transistor Tr2402.

Figure 31:
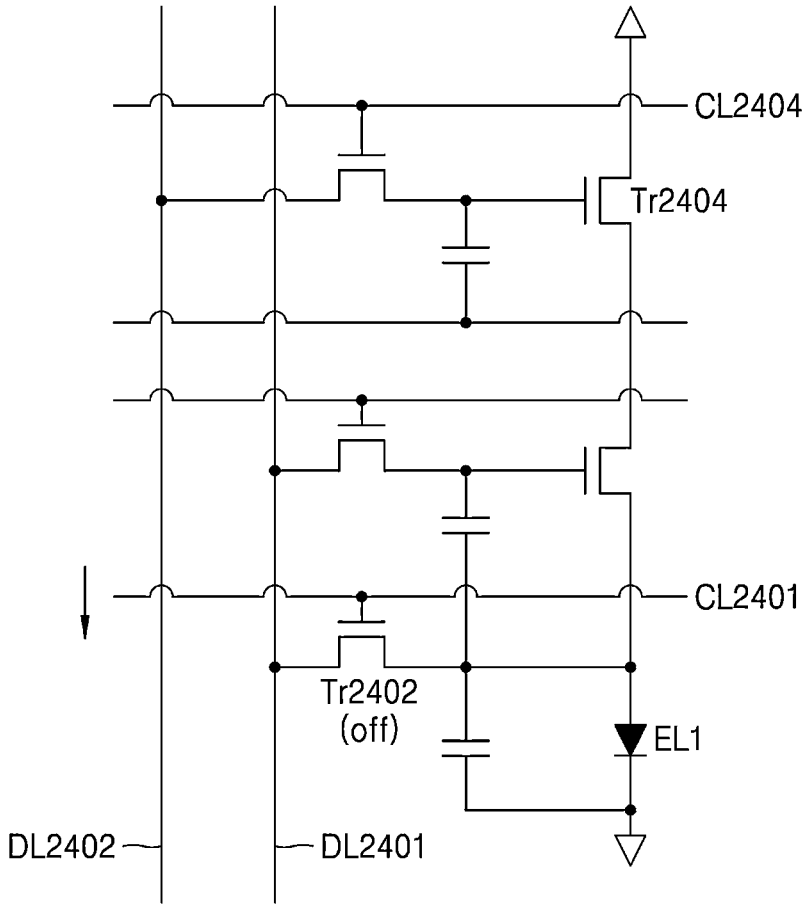
FIG. 31 is a diagram illustrating a driving state of the pixel circuit (10*f*) according to another embodiment of the present disclosure.

In addition, a potential of the twenty-fourth-first gate line CL2401 is set to L to cause the twenty-fourth-second transistor Tr2402 to be in the non-conducting state, light emission is simultaneously started by PWM with respect to the pixel circuits 10*f*, a potential of the twenty-fourth-fourth transistor Tr2404 is set to H for each sub-frame to write a PWM signal to a gate of the twenty-fourth-fourth transistor Tr2404, and a current value of the constant current controller 320*f* is controlled by time division to control emission gradation of the light-emitting diode EL1 (time t2509, FIG. 31).

When the light-emitting diode EL1 is emitting light, a potential of the twenty-fourth-first data line DL2401 may be set to a floating state and the potential of the twenty-fourth-first gate line CL2401 may be set to H to cause the twenty-fourth-second transistor Tr2402 to be in the conducting state not to turn off the light-emitting diode EL1, and an anode potential of the light-emitting diode EL1 may be detected by an light-emitting element evaluator inside or outside the display device 1 through the twenty-fourth-first data line DL2401.

That is, the display device 1 according to an embodiment uses two data lines, i.e., the twenty-fourth-first data line DL2401 and the twenty-fourth-second data line DL2402, and thus, characteristics of the light-emitting diode EL1 emitting light may be evaluated by detecting the anode potential of the light-emitting diode EL1 through the twenty-fourth-first data line DL2401 while supplying a PWM signal to the PWM controller 310*f* through the twenty-fourth-second data line DL2404.

In addition, the pixel circuit 10*f* according to the present embodiment may have a different configuration different from that shown in FIG. 24.

Figure 32:
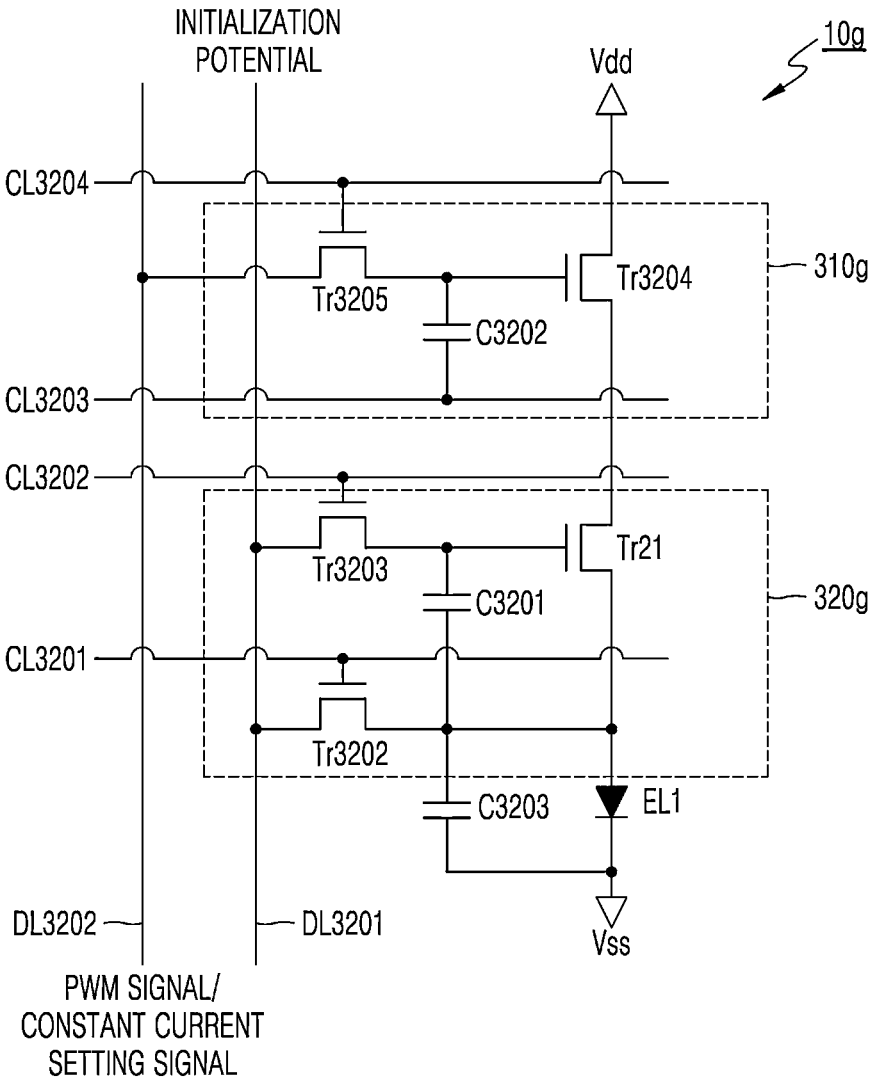
FIG. 32 is a circuit diagram illustrating a configuration of a pixel circuit (10*g*) according to another embodiment.

FIG. 32 is a circuit diagram illustrating a configuration of a pixel circuit 10*g* according to the present embodiment.

The configuration of the pixel circuit 10*g* is different from that of the pixel circuit 10*f* of FIG. 24, in that a drain terminal of a thirty-second-third transistor Tr3203 is electrically connected to a thirty-second-second data line DL3202, an initialization potential is supplied to a thirty-second-first data line DL3201, and a PWM signal and a constant current setting signal are supplied to the thirty-second-second data line DL3202.

Despite the above configuration, when the PWM signal is supplied through the thirty-second-second data line DL3202, characteristics of a light-emitting diode EL1 may be evaluated by detecting an anode potential of the light-emitting diode EL1 through the thirty-second-first data line DL3201.

As described above, in the display device 1 according to the present embodiment, data lines may include the thirty-second-first data line DL3201 and the thirty-second-second data line DL3202, a drain terminal of a thirty-second-second transistor Tr3202 may be connected to the thirty-second-first data line DL3201, a drain terminal of a thirty-second-third transistor Tr3203 may be connected to the thirty-second-first data line DL3201 or the thirty-second-second data line DL3202, and a drain terminal of a thirty-second-fifth transistor Tr3205 may be connected to the thirty-second-second data line DL3202.

Despite the above configuration, power lines may be shared between a plurality of pixel circuits 10*g* and an influence of potential fluctuation of the power lines may be greatly reduced.

In addition, the display device 1 according to the present embodiment may further include a light-emitting element evaluator connected to the thirty-second-first data line DL3201.

Due to the above configuration, characteristics of the light-emitting element that is emitting light may be evaluated.

An inspection method of a display device 1 according to another embodiment is an inspection method of a display device 1 with a pixel circuit 10*g* including: a light-emitting element EL1; a constant current controller 320*g* including a thirty-second-first transistor Tr3201, a thirty-second-first capacitor C3201 having one terminal connected to a gate terminal of the thirty-second-first transistor Tr3201 and another terminal connected to a source terminal of the thirty-second-first transistor Tr3201 and a terminal of the light-emitting element EL1, a thirty-second-second transistor Tr3202 having a source terminal connected to the source terminal of the thirty-second-first transistor Tr3201 and another terminal of the thirty-second-first capacitor C3201, a gate terminal connected to a thirty-second-first gate line CL3201, and a drain terminal connected to a drain terminal connected to a thirty-second-first data line DL3201, and a thirty-second-third transistor Tr3203 having a source terminal connected to the gate terminal of the thirty-second-first capacitor C3201 and a terminal of the thirty-second-first capacitor C3201, a gate terminal connected to a thirty-second-second gate line CL3202, and a drain terminal connected to the thirty-second-first data line DL3201 or a thirty-second-second data line DL3202, and configured to supply current to the light-emitting element EL1; and a PWM controller 310*g* including a thirty-second-fourth transistor Tr3204, a thirty-second-second capacitor C3202 having one terminal connected to a gate terminal of the thirty-second-fourth transistor Tr3204 and another terminal connected to a thirty-second-third gate line CL3203, and a thirty-second-fifth transistor Tr3205 having a source terminal connected to the gate terminal of the thirty-second-fourth transistor Tr3204 and a terminal of the thirty-second-second capacitor C3202, a gate terminal connected to a thirty-second-fourth gate line CL3204, and a drain terminal connected to the thirty-second-second data line DL3202, and configured to switch whether to supply current to the light-emitting element EL1, wherein the thirty-second-fourth transistor Tr3204, the thirty-second-first transistor Tr3201, and the light-emitting element EL1 are sequentially connected in series between a first power line Vdd and a second power line Vss to supply current to the light-emitting element EL1. When the light-emitting element EL1 is emitting light, a potential of one terminal of the light-emitting element EL1 is detected through the thirty-second-first data line DL3201.

Due to the above configuration, when the light-emitting element EL1 is emitting light, characteristics of the light-emitting element EL1 may be evaluated by measuring the potential of one terminal (e.g., the anode terminal) thereof.

The embodiments set forth herein have been described above with reference to the accompanying drawings. It will be understood by those of ordinary skill in the art to which the present disclosure pertains that the present disclosure may be implemented in a form different from the embodiments set forth herein without departing from the technical spirit or essential features of the present disclosure. The embodiments set forth herein are only examples and should not be construed as being limited thereto.

The invention claimed is:

1. A display device comprising:

a plurality of pixel circuits, a first pixel circuit of the plurality of pixel circuits comprising:

a light-emitting element;

pulse width modulation (PWM) control circuitry configured to control whether to supply current to the light-emitting element; and constant current control circuitry configured to supply the current to the light-emitting element, the constant current control circuitry comprising a first transistor and a second transistor, wherein the second transistor is directly connected between a data line and a gate terminal of the first transistor, wherein the constant current control circuitry, the PWM control circuitry, and the light-emitting element are connected in series between a first power line and a second power line to supply the current to the light-emitting element; and a transistor configured to turn off the light-emitting element during a constant current setting period, the transistor being provided between the first power line and the constant current control circuitry, wherein the constant current setting period comprises:

a PWM reset period for turning off the transistor configured to turn off the light-emitting element and initializing the transistor of the PWM control circuitry; and a constant current initialization period for initializing a gate-source voltage of a transistor of the constant current control circuitry to a threshold voltage after the PWM reset period, and wherein the initializing of the transistor of the PWM control circuitry is performed during the PWM reset period.

2. The display device of claim 1, further comprising emission control circuitry comprising a fifth transistor having a gate terminal connected to a third gate line, and wherein the PWM control circuitry comprises: a third transistor, a first capacitor having one terminal connected to a gate terminal of the third transistor, and a fourth transistor having a source terminal connected to the gate terminal of the third transistor and the one terminal of the third capacitor, a gate terminal connected to a first gate line, and a drain terminal connected to a data line, the constant current control circuitry further comprises: a second capacitor having one terminal connected to the gate terminal of the first transistor and another terminal connected to a source terminal of the first transistor, wherein the second transistor has a source terminal connected to the gate terminal of the first transistor and the one terminal of the second capacitor, a gate terminal connected to a second gate line, and a drain terminal connected to the data line, the fifth transistor, the first transistor, the third transistor, and the light-emitting element are sequentially connected in series between the first power line and the second power line to supply the current to the light-emitting element, and wherein the transistor configured to turn off the light-emitting element is the fifth transistor.

3. The display device of claim 2, wherein the emission control circuitry is commonly connected to a certain number of pixel circuits among the plurality of pixel circuits.

4. The display device of claim 1, further comprising timing control circuitry including an inverter circuit or a switching element and connected to the first gate line.

5. The display device of claim 2, wherein the first transistor, the second transistor, the third transistor, and the fourth transistor have a different conductivity type from the fifth transistor.

6. The display device of claim 1, wherein the constant current control circuitry comprises: a first capacitor having one terminal connected to a gate terminal of the first transistor and another terminal connected to a source terminal of the first transistor, wherein the first transistor is a source follow type, a source terminal of the second transistor is connected to the gate terminal of the first transistor and the one terminal of the first capacitor, a gate terminal of the second transistor is connected to a first gate line, and a drain terminal of the second transistor is connected to a data line, the PWM control circuitry comprises: a third transistor, a second capacitor having one terminal connected to a gate terminal of the third transistor, and a fourth transistor having a source terminal connected to the gate terminal of the third transistor and the one terminal of the second capacitor, a gate terminal connected to a second gate line, and a drain terminal connected to the data line, the third transistor, the first transistor, and the light-emitting element are sequentially connected in series between the first power line and the second power line to supply the current to the light-emitting element, and the transistor configured to turn off the light-emitting element is the third transistor.

7. The display device of claim 6, further comprising timing control circuitry including an inverter circuit or a switching element and connected to the second gate line.

8. The display device of claim 2, wherein a digital signal to be supplied to the PWM control circuitry and an analog signal to be supplied to the constant current control circuitry are supplied to the data line.

9. The display device of claim 1, wherein constant current setting is commonly performed by the constant current control circuitry with respect to the plurality of pixel circuits, and PWM control is individually performed by the PWM control circuitry with respect to rows of the plurality of pixel circuits.

10. The display device of claim 1, wherein the constant current control circuitry comprises: a first capacitor having one terminal connected to a gate terminal of the first transistor and another terminal connected to a source terminal of the first transistor and one terminal of the light-emitting element, wherein the first transistor is a source follow type, a source terminal of the second transistor is connected to the source terminal of the first transistor and another terminal of the first capacitor, a gate terminal of the second transistor is connected to a first gate line, and a drain terminal of the second transistor is connected to a data line, and the constant current control circuitry comprises: a third transistor connected to the gate terminal of the first transistor and the one terminal of the first capacitor, a gate terminal of the third transistor is connected a second gate line, and a drain terminal of the third transistor is connected to the data line, the PWM control circuitry comprises: a fourth transistor, a second capacitor having one terminal connected to a gate terminal of the fourth transistor and another terminal connected to a third gate line, and a fifth transistor having a source terminal connected to the gate terminal of the fourth transistor and the one terminal of the second capacitor, a gate terminal connected to a fourth gate line, and a drain terminal connected to the data line, and the fourth transistor, the first transistor, and the light-emitting element are sequentially connected in series between a first power line and the second power line to supply the current to the light-emitting element.

11. The display device of claim 10, wherein the data line comprises a first data line and a second data line, the drain terminal of the second transistor is connected to the first data line, the drain terminal of the third transistor is connected to the first data line or the second data line, and the drain terminal of the fifth transistor is connected to the second data line.

12. The display device of claim 11, further comprising a light-emitting element evaluator connected to the first data line.

13. The display device of claim 10, wherein the first transistor has a different conductivity type from the fourth transistor.

14. The display device of claim 10, wherein the first power line and the second power line are set to fixed potentials during one frame period.

15. A driving method of a display device including a plurality of pixel circuits, wherein one of the plurality of pixel circuits comprises: a constant current control circuitry, pulse width modulation (PWM) control circuitry and a light-emitting element, the PWM control circuitry being configured to control whether to supply current to the light-emitting element, and the constant current control circuitry comprising a first transistor and a second transistor, wherein the second transistor is directly connected between a data line and a gate terminal of the first transistor, the light-emitting element being connected in series with the constant current control circuitry and the PWM control circuitry between a first power line and a second power line to supply the current to the light-emitting element, and a transistor configured to turn off the light-emitting element in a constant current setting period and provided between the first power line and the constant current control circuitry, the driving method comprising:

initializing a transistor of the PWM control circuitry after start of the constant current setting period; and restoring the transistor of the PWM control circuitry to a state before the constant current setting period before start of a sub-frame period, wherein the constant current setting period comprises:

a PWM reset period for turning off the transistor configured to turn off the light-emitting element and initializing the transistor of the PWM control circuitry; and a constant current initialization period for initializing a gate-source voltage of a transistor of the constant current control circuitry to a threshold voltage after the PWM reset period, and wherein the initializing of the transistor of the PWM control circuitry is performed during the PWM reset period.

16. The driving method of claim 15, wherein, when the gate-source voltage of the transistor of the constant current control circuitry is set, transistor of the PWM control circuitry is in a conducting state.

* * * * *